US012550989B2

(12) United States Patent
Wahlstrom

(10) Patent No.: US 12,550,989 B2
(45) Date of Patent: Feb. 17, 2026

(54) SYSTEMS AND METHODS FOR SECURING VALUABLES

(71) Applicant: Sewn Brands LLC, Traverse City, MI (US)

(72) Inventor: Michael Brandon Wahlstrom, Traverse City, MI (US)

(73) Assignee: Sewn Brands LLC, Traverse City, MI (US)

( * ) Notice: Subject to any disclaimer, the term of this patent is extended or adjusted under 35 U.S.C. 154(b) by 0 days.

(21) Appl. No.: 18/759,066

(22) Filed: Jun. 28, 2024

(65) Prior Publication Data

US 2025/0089869 A1 Mar. 20, 2025

Related U.S. Application Data

(60) Provisional application No. 63/583,840, filed on Sep. 19, 2023.

(51) Int. Cl.
*A45C 13/20* (2006.01)
*A45C 13/00* (2006.01)
(Continued)

(52) U.S. Cl.
CPC ..... *A45C 13/20* (2013.01); *A45C 13/001* (2013.01); *A45C 13/008* (2013.01); *A45C 13/02* (2013.01);
(Continued)

(58) Field of Classification Search
CPC ..... A45C 13/20; A45C 13/001; A45C 13/008; A45C 13/02; A45C 13/103; A45C 2013/026; E05B 73/0017
(Continued)

(56) References Cited

U.S. PATENT DOCUMENTS 7,155,881 B1 1/2007 McGuire et al.
2011/0233253 A1 9/2011 Worthington
2016/0083147 A1* 3/2016 Mauro ..... A45C 13/103 383/22

FOREIGN PATENT DOCUMENTS

DE 2903393 A1 7/1980
EP 0845227 A2 6/1998
(Continued)

OTHER PUBLICATIONS

NPL Lockdown Kickstarter; Kickstarter campaign ran from Apr. 9, 2024-May 9, 2024. However, Kickstarter campaign NPL used to supplement NPL submitted by applicant with date of Jul. 23, 2023; "https://www.kickstarter.com/projects/lockdowninnovation/lockdown-anti-theft-beach-bags/description" (Year: 2023).*
(Continued)

*Primary Examiner* — Javier A Pagan
(74) *Attorney, Agent, or Firm* — Aurora Consulting LLC; Ashley Sloat; Tiffany Miller

(57) ABSTRACT

A method may include filling a first compartment with at least about 40 pounds of sand. A method may include securing one or more valuables in a second compartment. A method may include closing the second compartment. A method may include positioning the second compartment within the first compartment and closing, using a closure mechanism, the first compartment. A method may include at least partially crossing the closure mechanism with a lock mechanism to reduce manipulation of the closure mechanism to reduce access to the second compartment within the first compartment.

20 Claims, 18 Drawing Sheets

(51) Int. Cl.
*A45C 13/02* (2006.01)
*A45C 13/10* (2006.01)

(52) U.S. Cl.
CPC ..... *A45C 13/103* (2013.01); *A45C 2013/026* (2013.01)

(58) Field of Classification Search
USPC ..... 24/704.1; 70/57.1; 340/572.1
See application file for complete search history.

(56) References Cited

FOREIGN PATENT DOCUMENTS

| | | | |
|---|---|---|---|
| FR | 2850543 | A1 | 7/2007 |
| WO | 2005081616 | A2 | 9/2005 |
| WO | 2021086186 | A1 | 5/2021 |

OTHER PUBLICATIONS

"Let us introduce—LockDown the SandAnchor. Simply secure your valuables, wherever you are on the beach!" LockDown Innovation. Posted Jul. 23, 2023 via Instagram. https://www.instagram.com/p/CvC9dDpMvdh/?img_index=6.

* cited by examiner

SYSTEMS AND METHODS FOR SECURING VALUABLES

CROSS-REFERENCE TO RELATED APPLICATIONS

This application claims the priority benefit of U.S. Provisional Patent Application Ser. No. 63/583,840, filed Sep. 19, 2023, the contents of which are herein incorporated by reference in their entirety.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of sand environment related accessories, and more specifically, to the field of securing valuables. Described herein are systems and methods for securing valuables in a sand environment.

SUMMARY

In some aspects, the techniques described herein relate to a method of securing valuables including: filling a first compartment with more than about 40 pounds of sand; securing one or more valuables in a second compartment; positioning the second compartment within the first compartment; closing, using a closure mechanism, the first compartment; and at least partially crossing the closure mechanism with a lock mechanism to reduce manipulation of the closure mechanism to reduce access to the second compartment within the first compartment.

In some aspects, the techniques described herein relate to a method, wherein the at least partially crossing the closure mechanism includes securing a tether of the lock mechanism over the closure mechanism and under a hook of the closure mechanism.

In some aspects, the techniques described herein relate to a method, wherein the at least partially crossing the closure mechanism includes threading a tether of the lock mechanism through eyelets on opposite sides of the closure mechanism.

In some aspects, the techniques described herein relate to a method, wherein the lock mechanism includes a clamp, wherein the at least partially crossing the closure mechanism includes overlaying at least a portion of the closure mechanism with the clamp to reduce movement of a zipper slider of the closure mechanism.

In some aspects, the techniques described herein relate to a method, further including threading a coupling element of the clamp through an eyelet adjacent to the closure mechanism and securing a first clamp portion and a second clamp portion on opposite sides of the coupling element on a top portion and a bottom portion, respectively, of the first compartment.

In some aspects, the techniques described herein relate to a method, further including locking the first clamp portion into position over at least a portion of the closure mechanism.

In some aspects, the techniques described herein relate to a method, wherein closing the first compartment further includes parking at least one zipper pull or slider at an end of the closure mechanism of the first compartment.

In some aspects, the techniques described herein relate to a method, further including securing an external valuable to a loop of the first compartment.

In some aspects, the techniques described herein relate to a method, wherein the external valuable is one of: a watercraft, chair, pet, or child.

In some aspects, the techniques described herein relate to a method, wherein the closure mechanism includes a marine grade zipper.

In some aspects, the techniques described herein relate to a system for securing valuables including: a first compartment configured to store at least about 40 pounds of sand and including a closure mechanism; a second compartment configured to contain one or more valuables and is sized for positioning in the first compartment with the sand; and a lock mechanism configured to at least partially cross the closure mechanism to reduce manipulation of the closure mechanism to reduce access to the second compartment within the first compartment.

In some aspects, the techniques described herein relate to a system, further including a loop coupled to the first compartment, wherein the loop is couplable to an external valuable.

In some aspects, the techniques described herein relate to a system, wherein the external valuable is one of: a watercraft, chair, pet, or child.

In some aspects, the techniques described herein relate to a system, wherein the lock mechanism further includes a shackle configured to be secured under a hook of the closure mechanism.

In some aspects, the techniques described herein relate to a system, wherein the lock mechanism further includes a tether configured to be threaded through eyelets defined by the first compartment, the eyelets being on opposite sides of the closure mechanism.

In some aspects, the techniques described herein relate to a system, wherein the lock mechanism includes a clamp, wherein the clamp is configured to at least partially cross at least a portion of the closure mechanism to reduce movement of a zipper slider of the closure mechanism.

In some aspects, the techniques described herein relate to a system, wherein the clamp further includes a first clamp portion, a second clamp portion, and a coupling element, wherein the coupling element is configured to be threaded through an eyelet adjacent to the closure mechanism to secure the first clamp portion and the second clamp portion on a top portion and a bottom portion, respectively, of the first compartment.

In some aspects, the techniques described herein relate to a system, wherein the closure mechanism of the first compartment includes at least one zipper pull or slider configured to be parked at an end of the first compartment.

In some aspects, the techniques described herein relate to a system, wherein the closure mechanism includes a marine grade zipper.

In some aspects, the techniques described herein relate to a system, wherein the lock mechanism includes a keyed lock or a combination lock.

In some aspects, the techniques described herein relate to a method of securing valuables including filling a first compartment with about 40 to about 60 pounds of sand; positioning one or more valuables in a second compartment, wherein the second compartment is water-resistant; closing the second compartment; positioning the second compartment within the first compartment; closing the first compartment; and locking the first compartment.

In some aspects, the techniques described herein relate to a method, wherein a first volume of the first compartment is about 1,500 cubic inches to about 2,000 cubic inches and a second volume of the second compartment is about 150 cubic inches to about 300 cubic inches.

In some aspects, the techniques described herein relate to a method, wherein a first volume of the first compartment is about 5× to about 10× larger than a second volume of the second compartment.

In some aspects, the techniques described herein relate to a method, wherein a first material of the first compartment includes one or more of: polyester, cotton, linen, leather, elastane, or a combination thereof.

In some aspects, the techniques described herein relate to a method, wherein a second material of the second compartment includes one or more of: neoprene, rubber, elastane, econyl, nylon, polytetrafluoroethylene, or a combination thereof.

In some aspects, the techniques described herein relate to a method, wherein the first compartment includes a double-pull zipper for a closure mechanism.

In some aspects, the techniques described herein relate to a method, wherein locking further includes threading a lock mechanism through a first pull tab and a second pull tab of the zipper.

In some aspects, the techniques described herein relate to a method, wherein the first compartment further includes an accessory loop, wherein locking further includes threading the lock mechanism through the accessory loop.

In some aspects, the techniques described herein relate to a method, wherein the second compartment includes a zipper for a closure mechanism.

In some aspects, the techniques described herein relate to a system for securing valuables including: a first compartment configured to hold about 30 to about 70 pounds of sand and including a first closure mechanism; a second compartment including: a second closure mechanism, and a water-resistant material, wherein the second compartment is configured to contain one or more valuables and is sized for positioning in the first compartment with the sand; and a lock positionable to secure the first closure mechanism in a locked configuration.

In some aspects, the techniques described herein relate to a system, further including an accessory loop coupled to the first compartment.

In some aspects, the techniques described herein relate to a system, wherein the lock is configured to secure the first closure mechanism and the second closure mechanism to the accessory loop.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1:
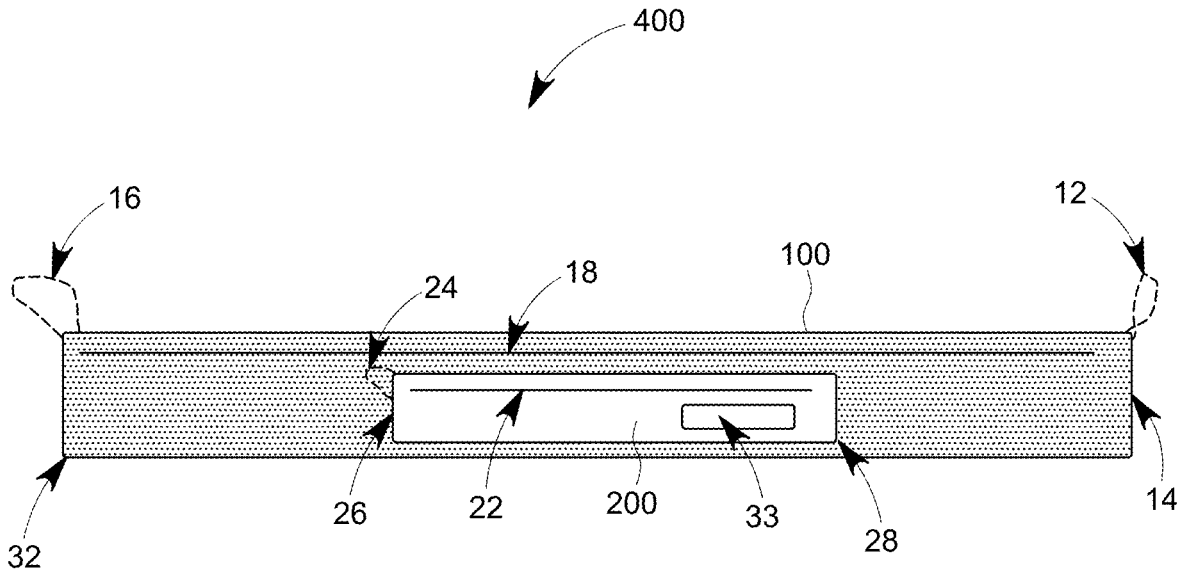
FIG. 1 shows a schematic of an embodiment of a system for securing one or more valuables in a sand environment.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the claimed subject matter. Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

In general, the systems and methods may be used to securely enclose any small valuables and/or personal belongings including, but not limited to: cellular phones, vehicle keys, dwelling keys, legal tender, wallets, passports, credit cards, personal care items, jewelry and accessories. Additionally, the system may be used to anchor to additional valuables using an accessory coupling element (e.g., loop, chain, etc.) including but not limited to: leashed pets, standup paddle boards, kayaks, watersport equipment, larger watercraft, garments, chairs, bicycles, floatation devices, personal watercraft, and children.

The systems and methods described herein are particularly suited for sand-based environments. A technical problem that securing valuables in sand environments poses includes jamming mechanical devices with the sand. Conventional mechanical devices are often rendered inoperable once jammed with sand and/or rusted due to the moisture in the sand (or moisture from a body of water in proximity to the sand). The systems described herein overcome this technical problem with a technical solution. A technical solution for this technical problem includes using a non-metal closure mechanism to prevent rusting. A further technical solution of this technical problem includes using high gauge closure mechanisms, for example a 7-gauge, 8-gauge, or 10-gauge slider to reduce jamming due to the sand interfering with the closure mechanism.

The systems and methods described herein further solve various technical problems related to tampering to gain access to valuables otherwise secured by the systems and methods described herein. For example, the systems and methods described herein solve the technical problem with the technical solution of a lock mechanism that prevents adjacent closure mechanisms (e.g., sliders, zipper pulls, etc.) from being manipulated apart to access an interior of a compartment. As described elsewhere herein, tampering can be particularly problematic when a material (e.g., fabric or otherwise) of the compartment is flexible or not taut. For example, even in a situation where adjacent closure mechanisms are maintained in proximity to one another, a side of the material can be manipulated to pull the material through the closure mechanism, thus allowing access to an interior of the compartment. This is generally not feasible with luggage since the material surrounding the zipper is taut and cannot be manipulated or pulled through the closure mechanism. Further, tampering can be particularly problematic when the compartment is insufficiently filled with sand. In such scenarios, the closure mechanisms may be manipulated apart (e.g., by pulling the material through the closure mechanism) to access an interior of the compartment where one or more valuables are stored or contained.

Various embodiments of lock mechanisms described herein solve the above technical problems with technical solutions by securing a closure mechanism of the compartment. Securing the closure mechanism of the compartment may include at least partially crossing or traversing the closure mechanism with a lock mechanism to reduce or prevent manipulation of the closure mechanism of the compartment. For example, various embodiments of lock mechanisms (e.g., 6-7B) described herein secure the zipper pulls (i.e., the lock mechanism crosses the closure mechanism by securing to the zipper pulls) to a loop on the compartment to reduce a likelihood of the zippers being manipulated apart. Further, various embodiments of lock mechanisms (e.g., FIGS. 8-9E) described herein secure the zipper pulls (and/or the slides of the zippers) in contact with one another using a cable or shackle or tie secured under a hook (e.g., between the hook and a slider of the closure mechanism) on at least one of the zipper pulls and/or zipper slide. The cable or shackle or tie at least partially passes over or at least partially crosses the closure mechanism to be secured under the hook. The cable or shackle or tie may prevent the zipper pulls from being manipulated apart by either preventing manipulation of the cable or shackle or tie over or around the hook or pulling the material through the closure mechanism. Further, various embodiments of lock mechanisms described herein provide a backstop to the zipper pulls and/or zipper slider to prevent a zipper pull or zipper slider from being navigated along the closure mechanism (e.g., navigated through the zipper teeth). For example, as shown in FIGS. 9F-9H, a first side and a second side of a closure mechanism are prevented from being separated thereby preventing access to an interior of the compartment. By providing a backstop (e.g., clamp, tether, etc.) to a zipper pull or zipper slider, the slider of the zipper is prevented from separating a first side and a second side of the closure mechanism, thereby preventing access to an interior of the compartment.

The systems and methods described herein function to secure one or more valuables within the system or a compartment of the system and to optionally and/or alternatively, secure or couple one or more external valuables (e.g., watercraft, child, pet, garments, chair, etc.) to the system. The system may include a first compartment and a second compartment, and a lock mechanism. In some embodiments, the system may optionally further include a lock outer shell and/or a body strap. In some embodiments, the system functions to secure and/or anchor one or more or a plurality of valuables. The systems and devices are used for anti-theft or as a theft deterrent, but can additionally or alternatively, be used for any suitable applications. The systems and devices can be configured and/or adapted to function for any suitable sandy environment.

Figure 2:
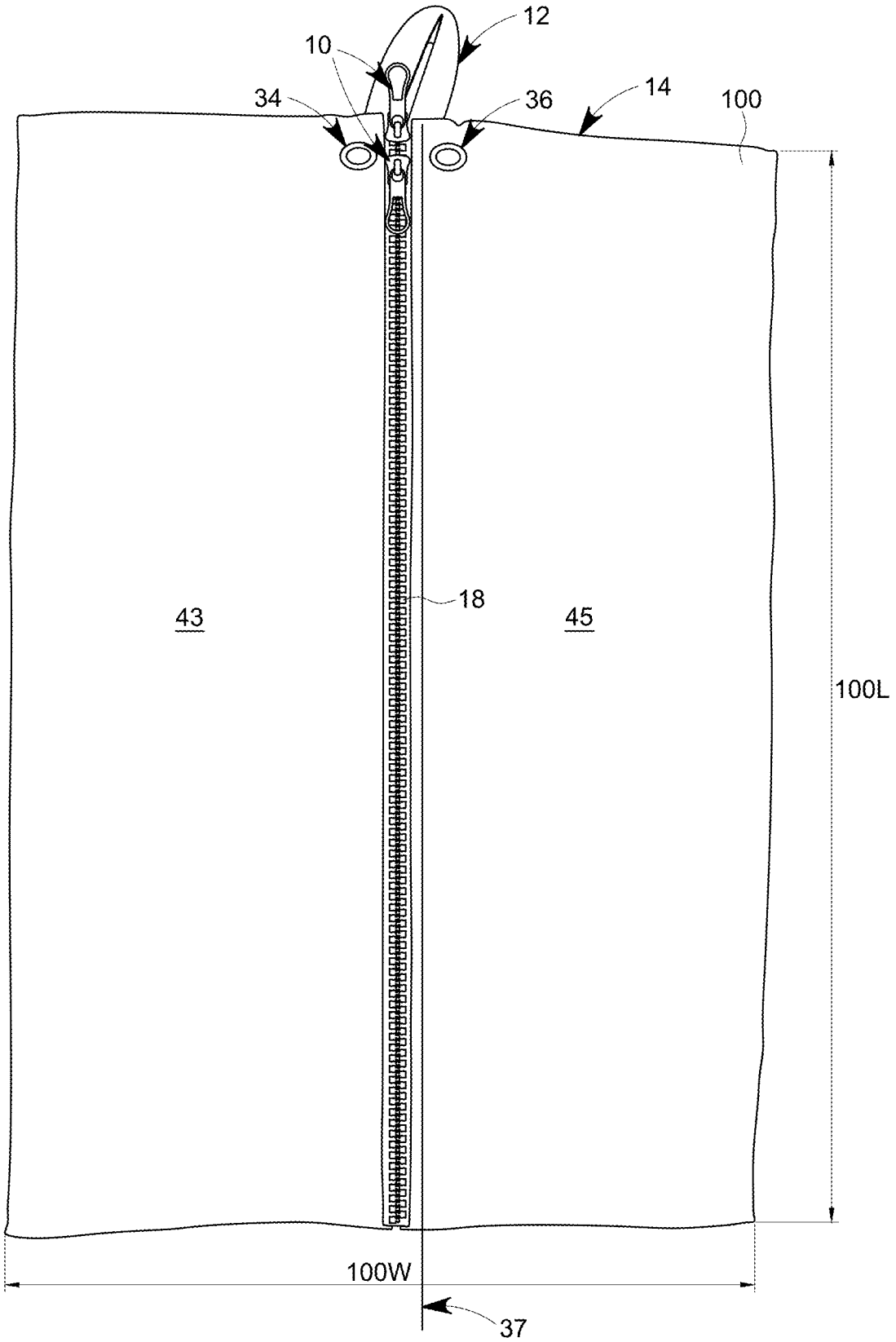
FIG. 2 shows an embodiment of a first compartment.
Figure 3:
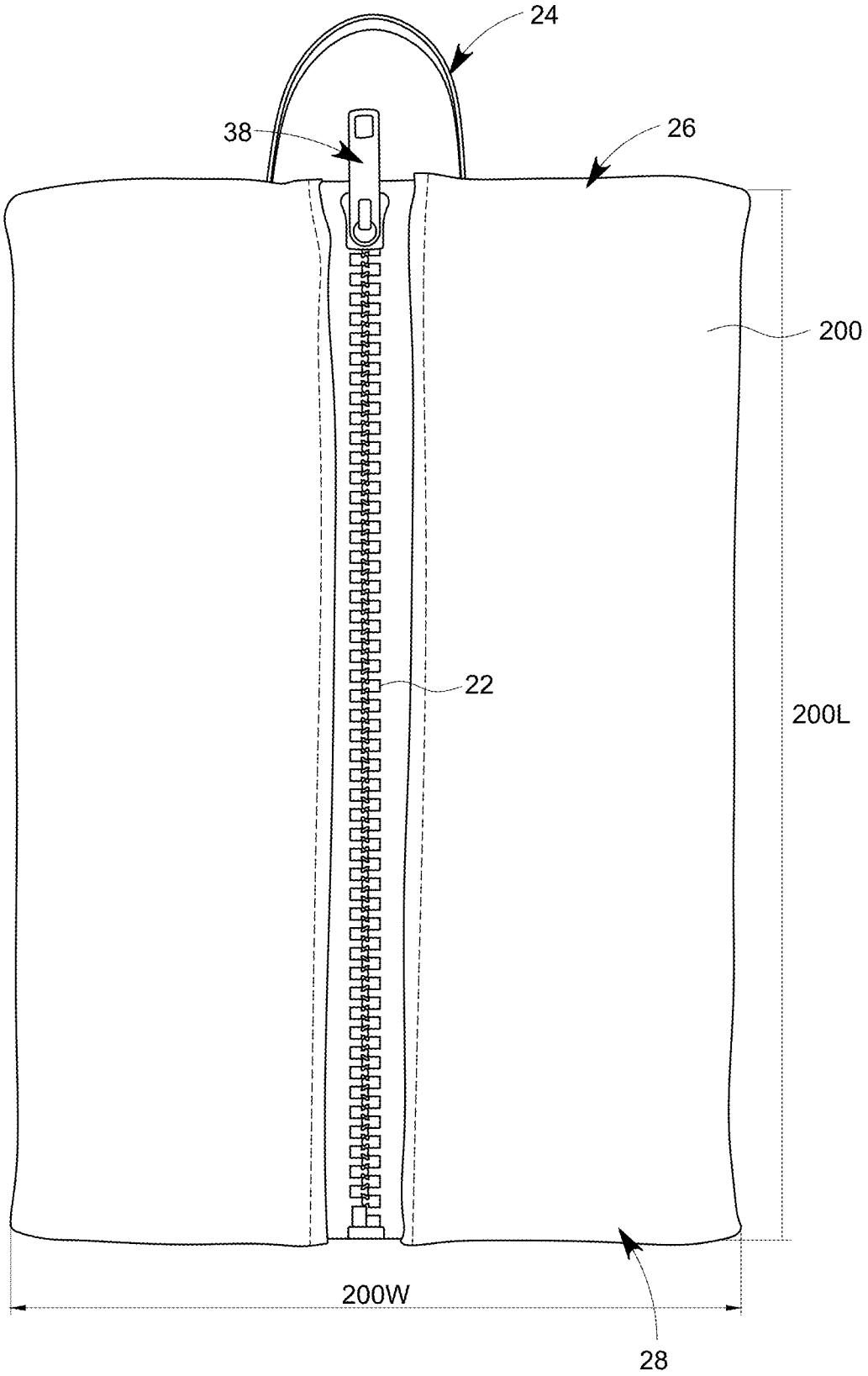
FIG. 3 shows an embodiment of a second compartment.

FIGS. 1-3 shows an embodiment of a system 400 for securing one or more valuables 33 in a sand environment. The system 400 may include a first compartment 100 and a second compartment 200. The second compartment 200 may be sized and/or shaped to receive one or more valuables 33 therein. The one or more valuables 33 may be contained by or stored in an interior of the second compartment 200 or contained within a volume defined by the second compartment 200. The second compartment 200 may be positionable within the first compartment 100. The first compartment 100 may be sized and/or shaped to receive sand to weigh down the system 400 to reduce a likelihood that a thief can easily transport the system 400 to steal the one or more valuables 33 stored or contained in the system 400. For example, a volume of the first compartment 100 may be about 1,000 cubic inches (0.0164 cubic meters) to about 2,500 cubic inches (0.041 cubic meters); about 1,200 cubic inches (0.02 cubic meters) to about 2,000 cubic inches (0.033 cubic meters); about 1,500 cubic inches (0.025 cubic meters) to about 2,000 cubic inches (0.033 cubic meters); about 1,600 cubic inches (0.026 cubic meters) to about 1,800 cubic inches (0.029 cubic meters); or about 1,700 cubic inches (0.028 cubic meters). A volume of the second compartment 200 may be about 50 cubic inches (0.0008 cubic meters) to about 500 cubic inches (0.008 cubic meters); about 100 cubic inches (0.002 cubic meters) to about 400 cubic inches (0.007 cubic meters); about 100 cubic inches (0.002 cubic meters) to about 300 cubic inches (0.005 cubic meters); about 150 cubic inches (0.00025 cubic meters) to about 250 cubic inches (0.004 cubic meters); or about 210 cubic inches (0.003 cubic meters). In some embodiments, the first compartment 100 may be about 5× to about 15×; about 5× to about 10×; about 6× to about 9×; about 5× to about 8×; about 7× to about 9×; or about 8× larger than the second compartment 200.

The first compartment 100, as further shown in FIG. 2, may include a closure mechanism 18, an optional first loop 12, and an optional second loop 16. Although closure mechanism 18 is shown substantially coincident or aligned with longitudinal axis 37, one of skill in the are the art will appreciate that closure mechanism 18 may be offset from the longitudinal axis 37 and may instead be positioned on a first side 43 or a second side 45 of the second compartment 18, the first side 43 being opposite the second side 45. Further, closure mechanism 18 may be perpendicular to longitudinal axis 37, at least in some embodiments. The same may be true for closure mechanism 22 of the second compartment 200. The first loop 12, when present, may be on a first end 14 of the first compartment 100. The second loop 16, when present, may be on a second end 32 of the first compartment 100, the second end 32 being opposite the first end 14. Although two optional loops are shown, one of skill in the art will appreciate that any number of loops may be present on any sides of the first compartment 100.

Closure mechanism 18 may be a hook and loop fastener, a zipper, or the like. In some embodiments, the closure mechanism 18 is a marine grade zipper. In some embodiments, the closure mechanism 18 is a 10-gauge zipper. In some embodiments, the closure mechanism 18 includes or is formed of a nonmetal material, for example plastic. In some embodiments, the closure mechanism 18 includes one or more zipper pulls 10, for example one zipper pull or two zipper pulls (i.e., one or more zipper sliders). The one or more zipper pulls 10 (or zipper sliders) may be parked or aggregated near or proximate to the first end 14 (or alternatively end 32) of the first compartment 100. As described elsewhere herein, the one or more zipper pulls 10 (or zipper pulls) may be parked or aggregated proximate to loop 12 (or alternatively loop 16) so that loop 12 may be secured to the one or more zipper pulls 10 to lock the first compartment 100. In some embodiments, the first compartment 100 may further include or define one or more eyelets 24, 26 for further securing the closure mechanism.

The first compartment may have a length 100L of about 15 inches (38.1 cm) to about 30 inches (76.2 cm); about 20 inches (50.8 cm) to about 25 inches (63.5 cm); about 20 inches (50.8 cm) to about 30 inches (76.2 cm); about 25 inches (63.5 cm) to about 30 inches (76.2 cm) such that at least about 40 pounds or about 40 pounds (18.1 kg) to about 60 pounds (27.2 kg) can be stored in or held by the first compartment 100. The first compartment 100 may have a width 100W of about 10 inches (25.4 cm) to about 25 inches (63.5 cm); about 15 inches (38.1 cm) to about 20 inches (50.8 cm); about 10 inches (25.4 cm) to about 15 inches (38.1 cm); about 17 inches (43.2 cm) to about 25 inches (63.5 cm) such that about at least about 40 pounds or about 40 pounds (18.1 kg) to about 60 pounds (27.2 kg) can be stored in or held by the first compartment 100.

The second compartment 200, as further shown in FIG. 3, may include an optional loop 24 on a first end 26 of the second compartment. The first end 26 of the second compartment 200 is opposite a second end 28 of the second compartment 200. Closure mechanism 22 may be used to close the second compartment 200. For example, one or more valuables 33 may be positioned in an interior of the second compartment 200 and secured within the second compartment 200 using closure mechanism 22. Closure mechanism 22 may be a hook and loop fastener, a zipper, or the like. In some embodiments, the closure mechanism 22 is a marine grade zipper. In some embodiments, the closure mechanism 22 is a 7-gauge zipper, an 8-gauage zipper, or a 10-gauge zipper. For example, the second compartment 200 may include a closure mechanism 22 including a zipper slider with a zipper pull 38. In some embodiments, the closure mechanism 22 includes or is formed of a nonmetal material, for example plastic.

The second compartment 200 may have a width 200W of about 5 inches (12.7 cm) to about 15 inches (38.1 cm); about 5 inches (12.7 cm) to about 10 inches (25.4 cm); about 6 inches (15.24 cm) to about 8 inches (20.32 cm); etc. The second compartment 200 may have a length 200L of about 5 inches (12.7 cm) to about 15 inches (38.1 cm); about 5 inches (12.7 cm) to about 10 inches (25.4 cm); about 7 inches (17.8 cm) to about 12 inches (30.5 cm); about 8 inches (20.3 cm) to about 10 inches (25.4 cm); etc. The dimensions 200W, 200L of the second compartment 200 may be sufficiently large such that one or more valuables 33 can be secured or stored therein. For example, the second compartment 200 may be sized to receive a key or key fob. The second compartment 200 may be sized to receive a mobile phone. The second compartment 200 may be sized to receive a credit card or a wallet. The second compartment 200 may be sized to receive a plurality of valuables.

As shown in FIG. 1, the first compartment 100 may be filled with sand. The second compartment 200 may be positionable in the first compartment 100, and the first compartment may be locked. Although the description and figures described herein show the first compartment 100 being filled with sand first, one of skill in the art will appreciate that the first compartment 100 may be filled with sand prior to or after positioning the second compartment 200 in the first compartment 100.

In some embodiments, the first compartment 100 can be stored inside (e.g., in a folded or bunched state) in the second compartment 200 for convenience and/or transportation until unpacked and activated to function as an anchor or sandbag weight when filled and packed with sand in a sandy environment or using other available sand. A person's hands or similar scooping tool may be used to fill the first compartment 100 to capacity creating a weighted sand bag at an average weight of at least about 40 pounds; about 30 pounds (13.6 kg) to about 70 pounds (31.8 kg), about 40 pounds (18.1 kg) to about 60 pounds (27.2 kg), about 35 pounds (15.9 kg) to about 55 pounds (24.9 kg), or about 50 pounds (22.7 kg) full to substantially maximum mass volume. The second compartment 200 may be used to enclose or contain one or more valuables 33 and/or personal belongings including, but not limited to: cellular phones, vehicle keys, dwelling keys, legal tender, wallets, passports, credit cards, personal care items, jewelry and accessories. Once the second compartment 200 sufficiently contains the one or more valuables 33 and is closed (e.g., using the closure mechanism 22), the second compartment 200 may be positioned inside the first compartment 100. The first compartment 100 may be closed (e.g., using the closure mechanism 18). The closure mechanisms 18, 22 (e.g., zipper pulls) of the first and second compartments 100, 200, respectively, may be pulled together at an end 14, 32 of the first compartment 100. For example, when securing the zipper pulls 10 to a loop 12, 16, the zipper pulls 10 may be advanced to the end 14, 32 of the first compartment 100 that is closest to the respective loop 12, 16. When securing to loop 12, the pulls 10 may be parked at end 14. When securing to loop 16, the pulls 10 may be parked at end 32.

Figure 4:
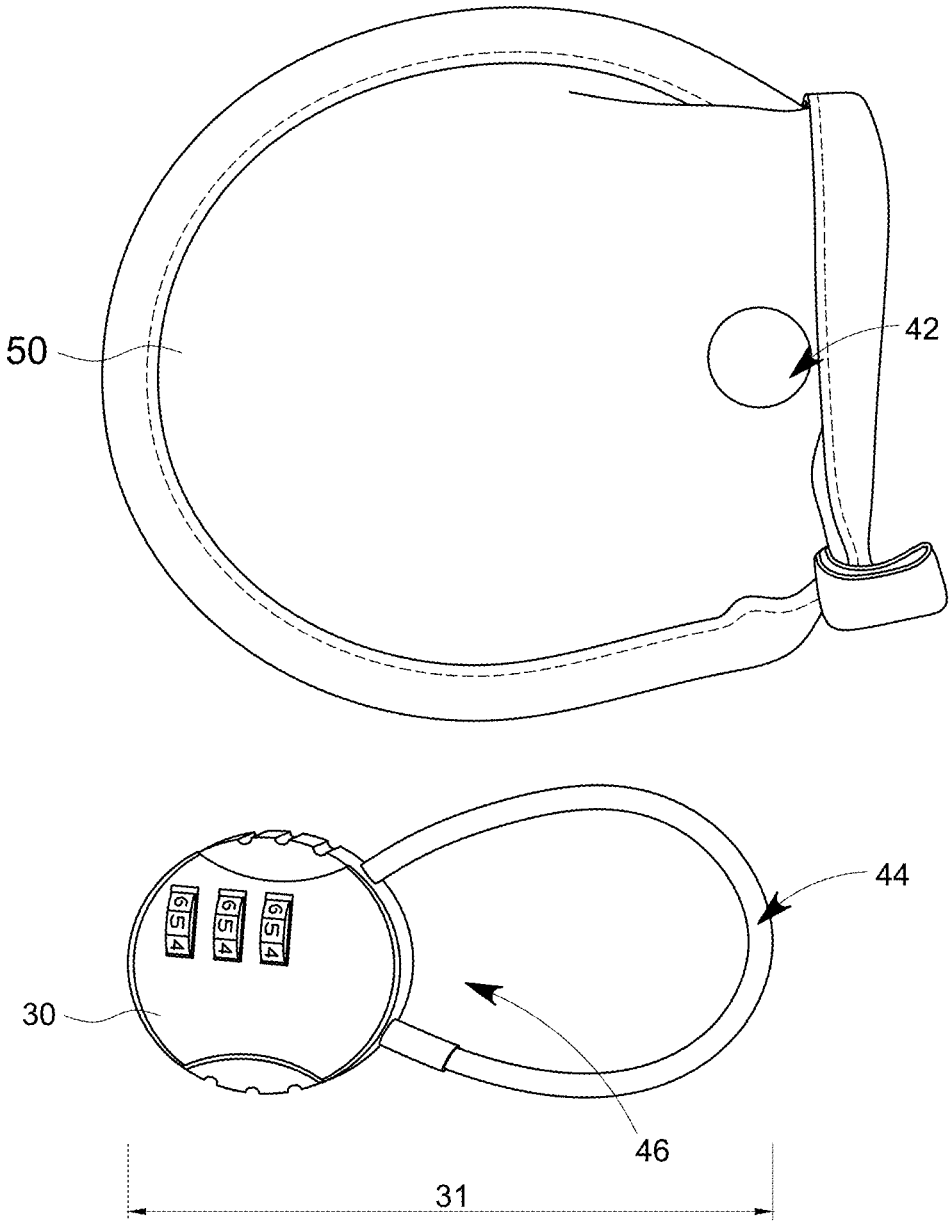
FIG. 4 shows an embodiment of a lock mechanism and an optional outer shell for storing the lock mechanism.
Figure 5B:
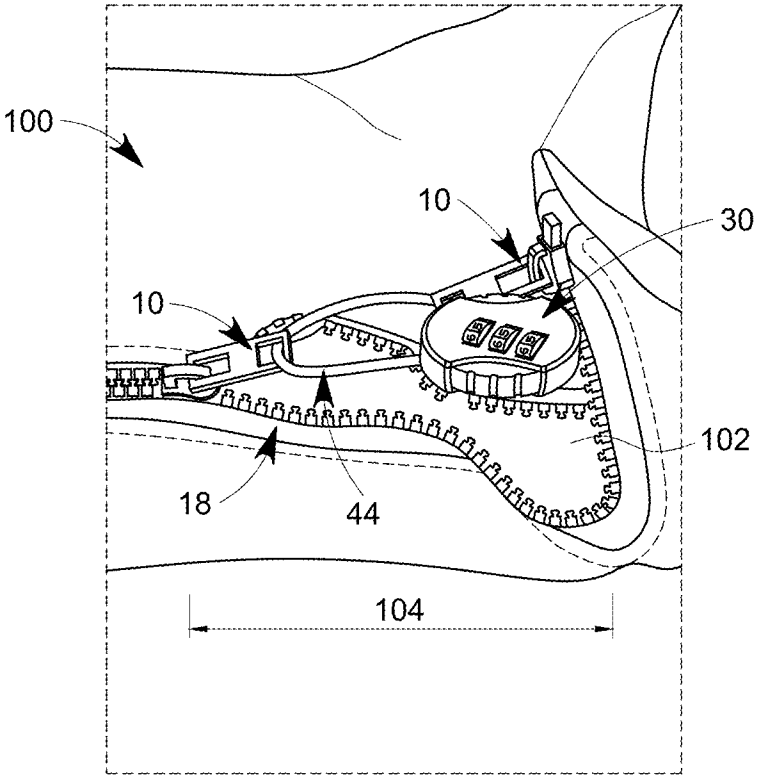
FIG. 5B shows an embodiment of a lock mechanism where access to one or more valuables stored in the system remains achievable.
Figure 5A:
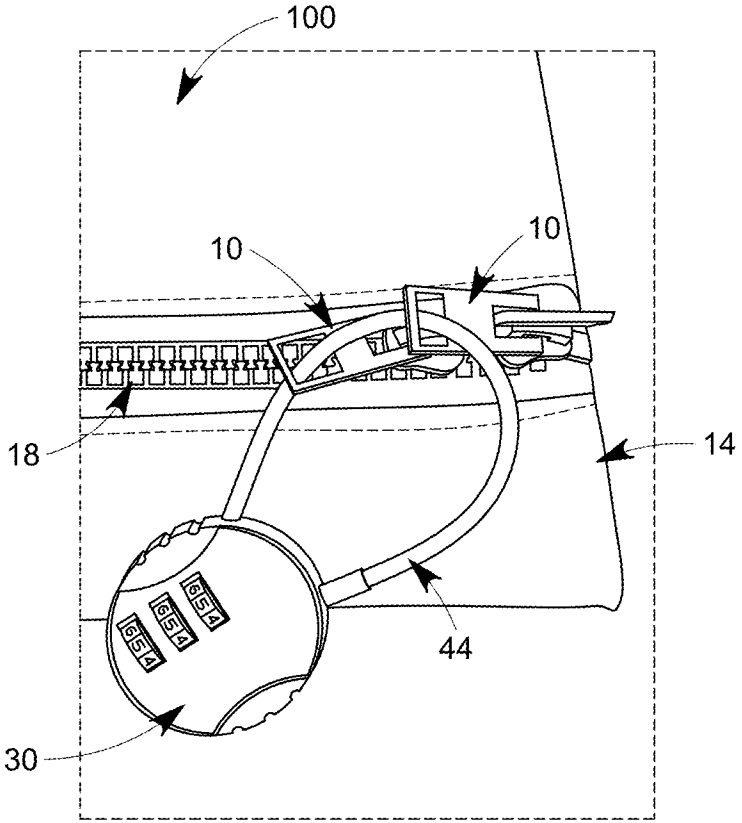
FIG. 5A shows a zoomed-in view of an embodiment of a lock mechanism secured to two closure mechanisms of a first compartment.
Figure 6:
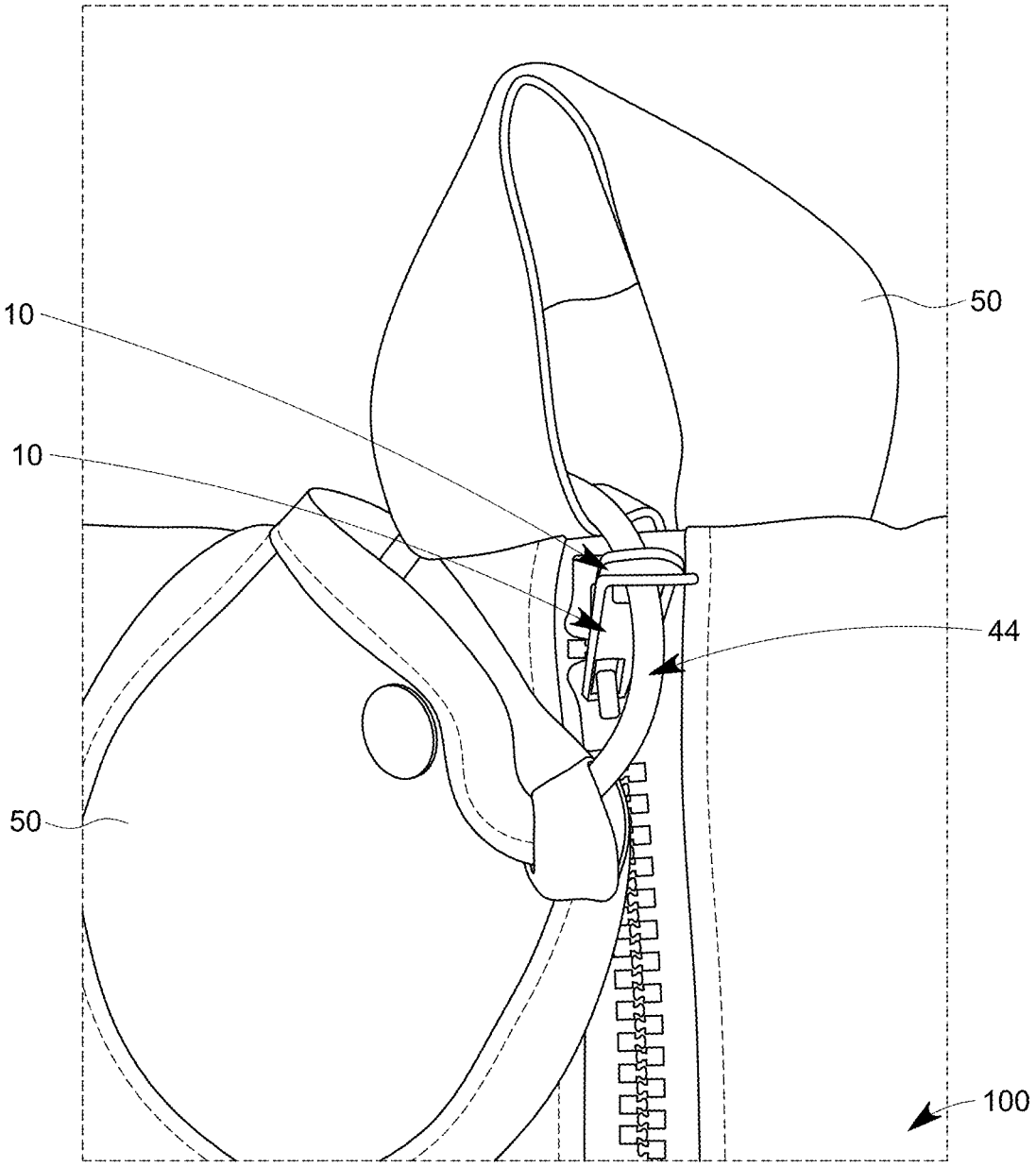
FIG. 6 shows a zoomed-in view of an embodiment of a lock mechanism secured to two closure mechanisms and a loop of a first compartment.

In some embodiments, as shown in FIGS. 4 and 5A, a lock mechanism 31 may be threaded through the combined closure mechanisms (e.g., threaded through combined zipper pulls) to secure the closure mechanism. In some embodiments, as shown in FIG. 6, the system additionally includes a loop 40 such that the closure mechanisms 18 may be further secured to the loop 40. For example, the lock mechanism 31 may be threaded through the pulls 10, 10 of the closure mechanism 18 and the loop 40. The lock mechanism 31 includes a lock body 30 including a shackle 44 that can be threaded through one or more zipper pulls 10 and a loop 40 of the first compartment 100. Optionally, as shown in FIG. 4, an outer shell 50 (e.g., pouch, pocket, receptacle, container, etc.) may be included to reduce sand interaction with the lock mechanism 31, when the lock mechanism 31 is at least partially positioned in the outer shell 50. The outer shell 50 can include a clasp 42 that secures the lock body 30 in the outer shell 50. The clasp 42 may be positionable in an aperture 46 defined by the shackle 44 when the shackle 44 is seated in the lock body 30.

Figure 12:
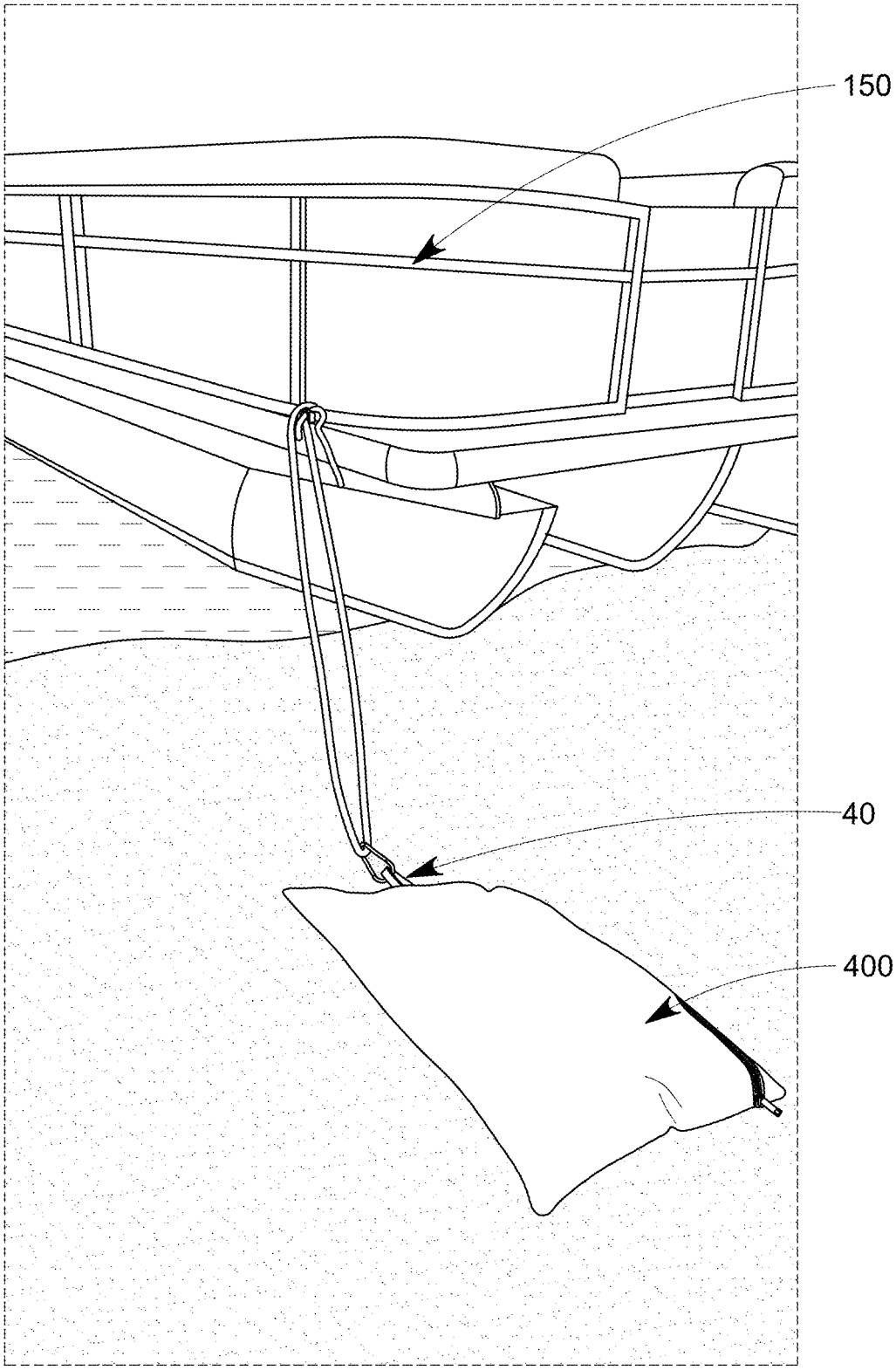
FIG. 12 shows an embodiment of a system for securing one or more external valuables in a sand environment.

The lock mechanism 31 may include a combination lock. The lock mechanism 31 may include a keyed lock. The lock mechanism 31 may include a zip lock. The lock mechanism 31 may include a lock cable male end that can be inserted into a combination lock female receptacle to secure the second compartment 200 inside the first compartment 100. The system 400 including the first compartment 100, second compartment 200, and lock mechanism 31 may function as a heavily weighted theft deterrent. In some embodiments, an example of which is shown in FIG. 12, the system 400 optionally further includes one or more loops 40 on the first compartment 100 that function to anchor or couple to an external valuable 150 including but not limited to: a leashed pet, a standup paddle board, a kayak, watersport equipment, garments, a chair, a bicycle, a floatation device, a personal watercraft, a large watercraft, a child, and the like.

FIG. 5A shows two zipper pulls 10 proximate to an end 14 of the first compartment 100 (i.e., the pulls 10 parked or aggregated at an end 14 of the first compartment 100) to secure the first compartment 100 in a closed configuration to reduce or prevent access to a second compartment 200 stored in the first compartment 100 and/or to de-weight the system to enable theft of an external valuable (e.g., boat, bike, watercraft, child, pet, chair, etc.). The shackle 44 coupled to the lock body 30 is threaded through the zipper pulls 10 to maintain the zipper pulls 10 in contact with one another to prevent access to an interior of the first compartment 100. However, as shown in FIG. 5B, the configuration of the lock body 30 and the pulls 10 may still allow access to an interior 102 of the first compartment 100, especially when the first compartment 100 is not sufficiently filled with sand. The material around the two zipper pulls 10 may be manipulated to cause a gap 104 of material between the zipper pulls 10, thus opening at least a portion of the closure mechanism 18 and allowing access to an interior 102 of the first compartment 100.

A technical solution, as shown in FIG. 6, to the technical problem identified in FIG. 5B is to thread the shackle 44 coupled to the lock body 30 (within outer shell 50) through pulls 10 and through loop 40 of the first compartment 100. As shown in FIG. 6, the two zipper pulls 10 (and zipper sliders) are positioned proximate to an end 14 of the first compartment 100 (i.e., the pulls 10 parked or aggregated at an end 14 of the first compartment 100) and adjacent to loop 40. Looping the shackle 44 through the pulls 10 and the loop 40 reduces the likelihood that the pulls 10 and/or material surrounding the pulls 10 can be manipulated apart by a thief attempting to access an interior of the first compartment 100.

Figure 7B:
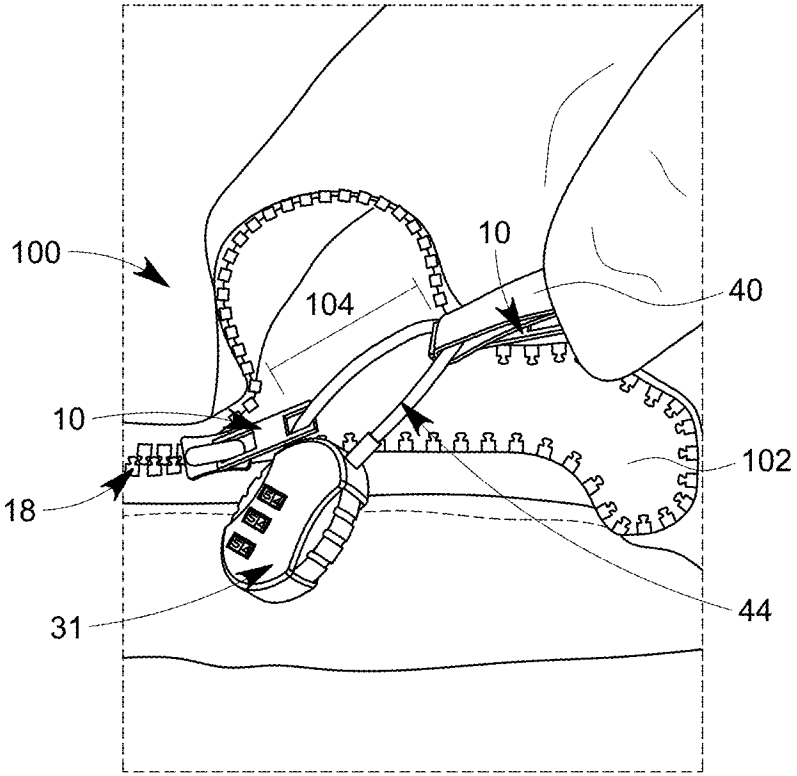
FIG. 7B shows an alternative, zoomed-in view of the embodiment of FIG. 6 where access to one or more valuables stored in the system may remain achievable.
Figure 7A:
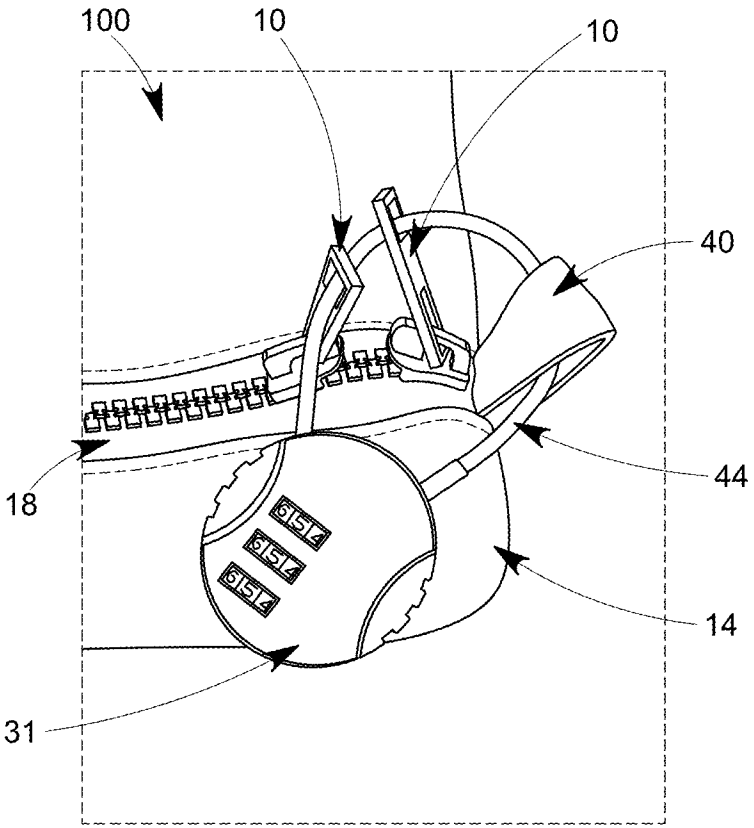
FIG. 7A shows a zoomed-in view of the embodiment of FIG. 6.

FIGS. 7A-7B show a possible technical problem with the technical solution of FIG. 6. Similar to FIG. 6, FIG. 7A shows two zipper pulls 10 (and zipper sliders) proximate to an end 14 of the first compartment 100 (i.e., the pulls 10 and zipper sliders are parked or aggregated at an end 14 of the first compartment 100). The shackle 44 coupled to the lock mechanism 31 is threaded through the zipper pulls 10 and the loop 40 to maintain the pulls 10 in contact with one another to reduce or prevent access to an interior of the first compartment 100. However, as shown in FIG. 7B, the configuration of the lock mechanism 31, loop 40, and pulls 10 may still allow access to an interior 102 of the first compartment 100, especially when the first compartment 100 is not sufficiently filled with sand. The two zipper pulls 10 and/or material surrounding the zipper pulls 10 may be manipulated to cause a gap 104 between the zipper pulls 10. The gap 104 results in opening in at least a portion of the closure mechanism 18 and allows access to an interior 102 of the first compartment 100.

Figure 8:
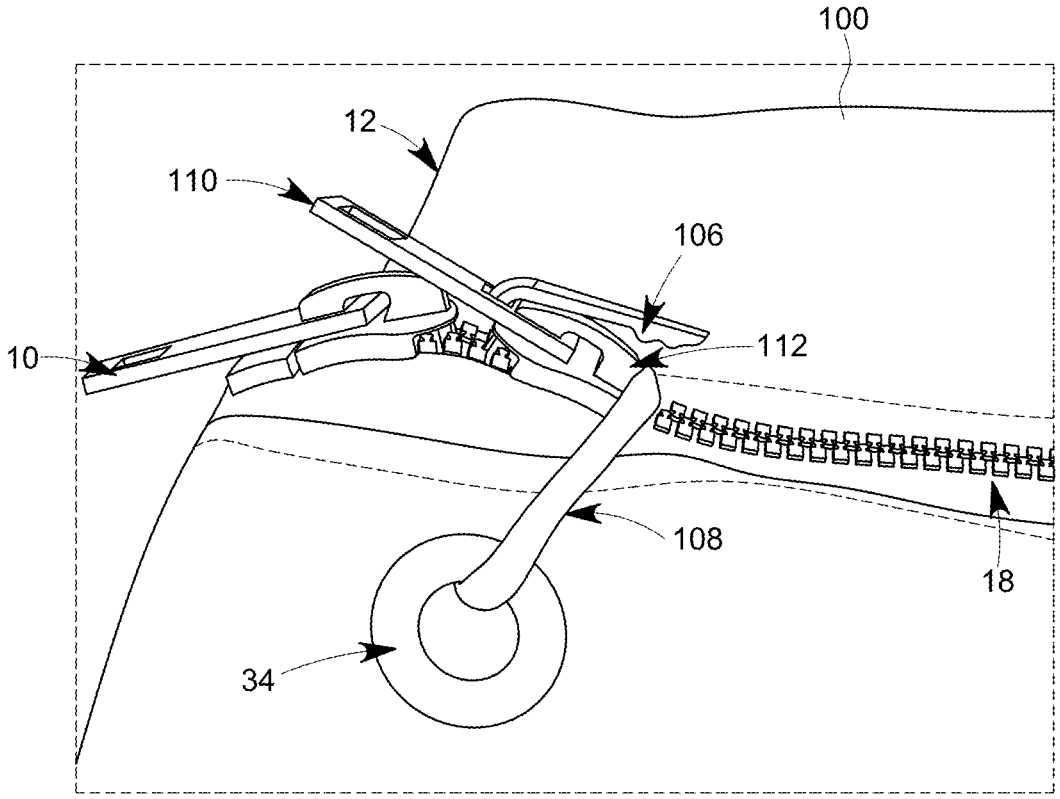
FIG. 8 shows a side perspective view of an embodiment of a mechanism for securing one or more valuables within the first compartment or a second compartment stored in the first compartment.
Figure 9B:
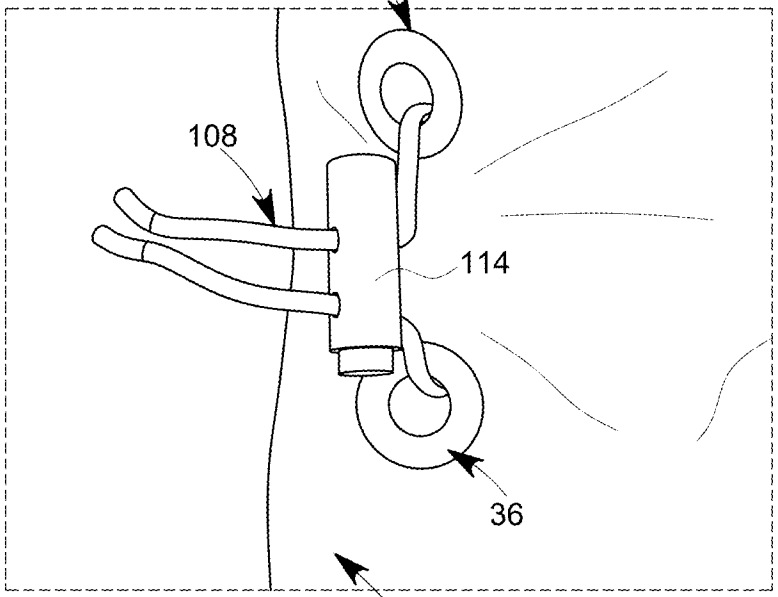
FIG. 9B shows a zoomed-in, bottom view of an embodiment of a lock mechanism for securing a compartment, according to FIG. 8.
Figure 9A:
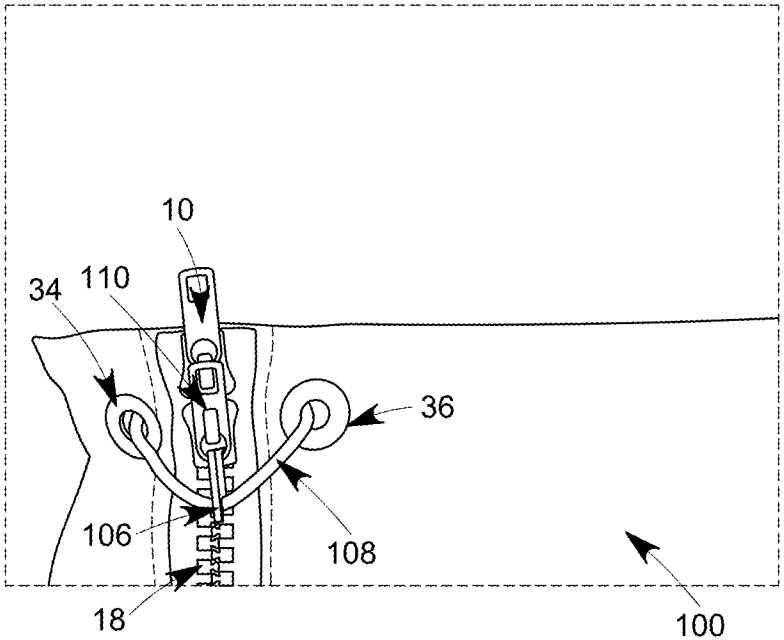
FIG. 9A shows a zoomed-in, top view of the embodiment of FIG. 8.

As shown in FIGS. 8 and 9A-9E, a technical solution to the technical problem identified in FIGS. 5B and 7B is to at least partially cross, pass over, or traverse the closure mechanism 18 with the lock mechanism 31 to reduce or prevent manipulation of the closure mechanism 18. At least partially crossing or traversing the closure mechanism 18 may include threading at least a portion of the lock mechanism 31 through eyelets 34, 36 (in or defined by the first compartment) on opposite sides of the closure mechanism 18. As shown in FIG. 2, eyelets 34, 36 are on a same end (end 14 or end 32) of the first compartment 100 and on opposite sides of the closure mechanism 18. Said another way, the closure mechanism 18 passes between the eyelets 34, 36. Said still another way, a first eyelet 34 is on a first side 43 of a longitudinal axis 37 of the first compartment 100 and a second eyelet 36 is on a second side 45 of the longitudinal axis 37 of the first compartment 100. The first eyelet 34 is on an opposite side of the longitudinal axis 37 than the second eyelet 36. As shown in FIGS. 9A-9E, the eyelets 34, 36 are sized and shaped to receive a tether 108 (e.g., tie or shackle or cable) therethrough. The tether 108 that can extend between the eyelets 34, 36 (e.g., the shackle or cable straddles, passes over, or crosses the closure mechanism) is secured in a modified zipper 110, for example a modified zipper pull or a modified zipper slider. As shown in FIG. 9A, the tether 108 can be secured underneath a hook 106 of the modified zipper 110 (pull or slider), between the hook 106 and the zipper slider 112. Securing the tether 108 in the modified zipper 110 can reduce or prevent the tether 108 from slipping out (or being pushed or manipulated out) and over the zipper 110 once secured and reduces the likelihood that the zipper 10, 110 can be manipulated apart (or the material surrounding the closure mechanism) by a thief attempting to access the interior of the first compartment 100. Although two zipper pulls (or sliders) 110, 10 are shown in FIG. 8, one of skill in the art will appreciate that only the modified zipper 110 may be used to secure or lock the closure mechanism of the first compartment 100 or a closure mechanism 18 coupled to a hook or other curved element may be used. Said another way, the embodiment of FIG. 8 may function with a modified zipper 110 (without a second zipper). The modified zipper 110 may be parked at an end 14 or end 32 of the first compartment 100 (or at an end of the closure mechanism 18) and secured with the tether as described above.

Figure 9D:
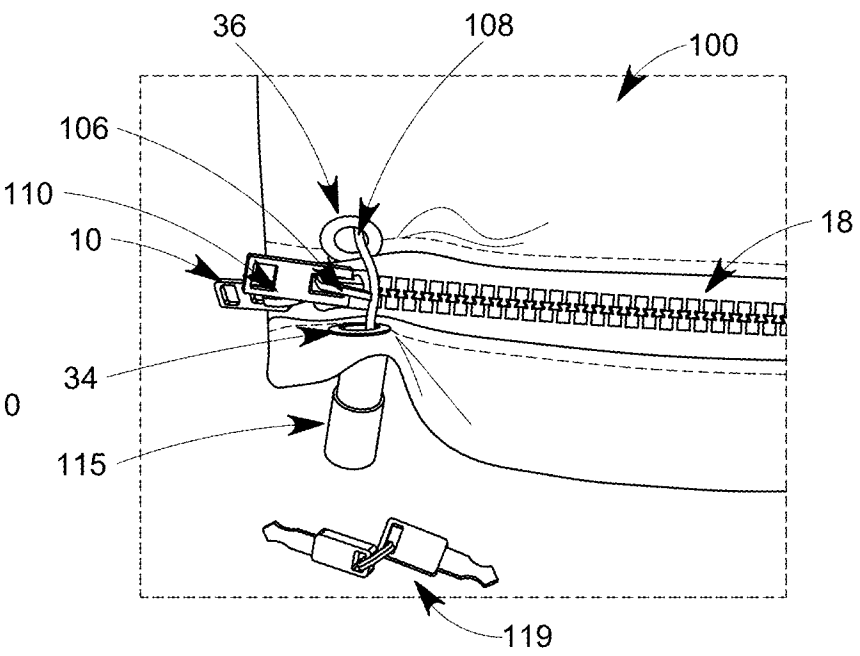
FIG. 9D shows a zoomed-in, top view of an embodiment of a lock mechanism for securing a compartment.
Figure 9C:
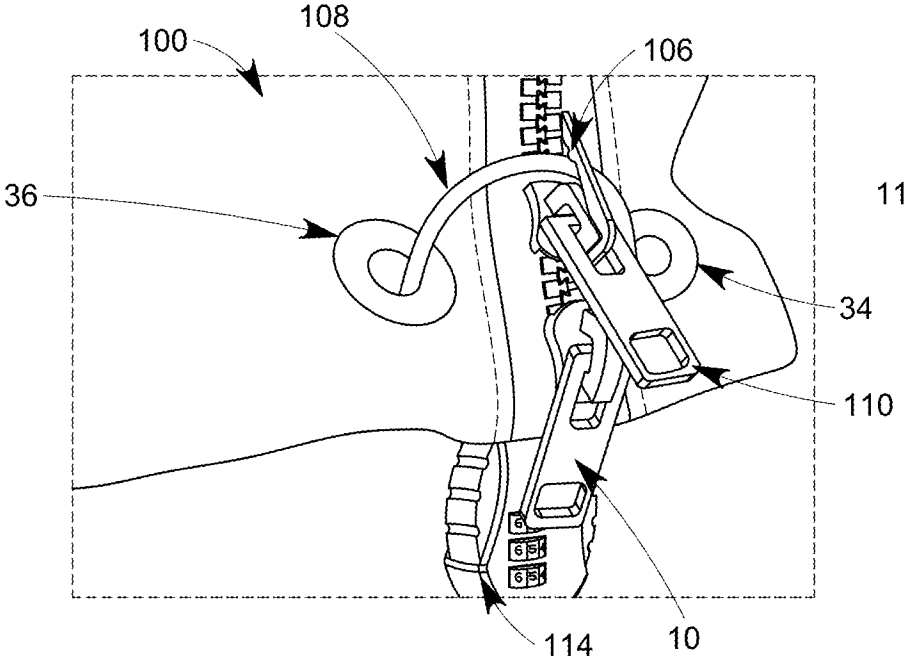
FIG. 9C shows a zoomed-in, top view of an embodiment of a lock mechanism for securing a compartment.
Figure 9E:
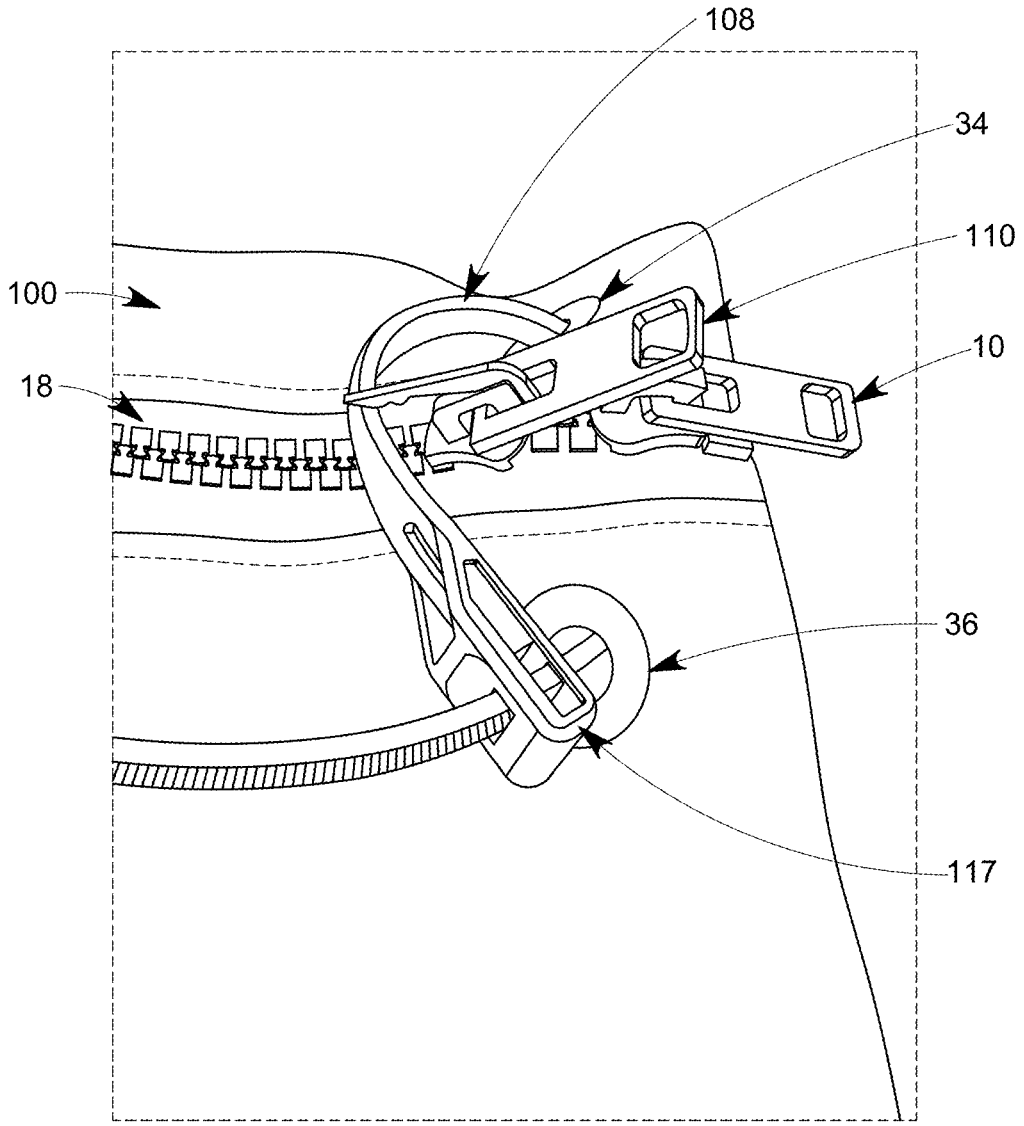
FIG. 9E shows a zoomed-in, top view of an embodiment of a lock mechanism for securing a compartment.
Figure 9F:
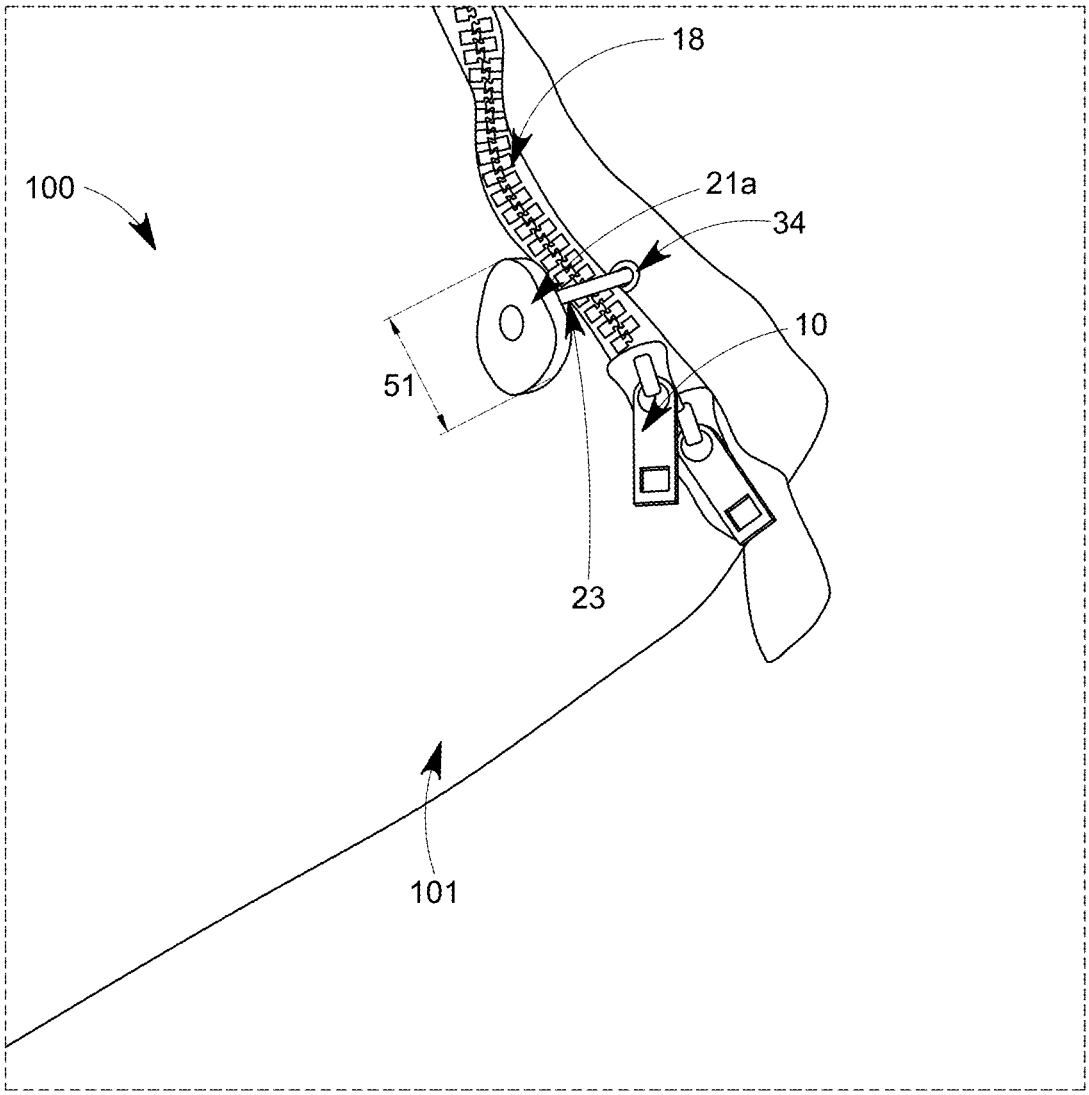
FIG. 9F shows a zoomed-in, perspective view of an embodiment of a lock mechanism for securing a compartment.
Figure 9G:
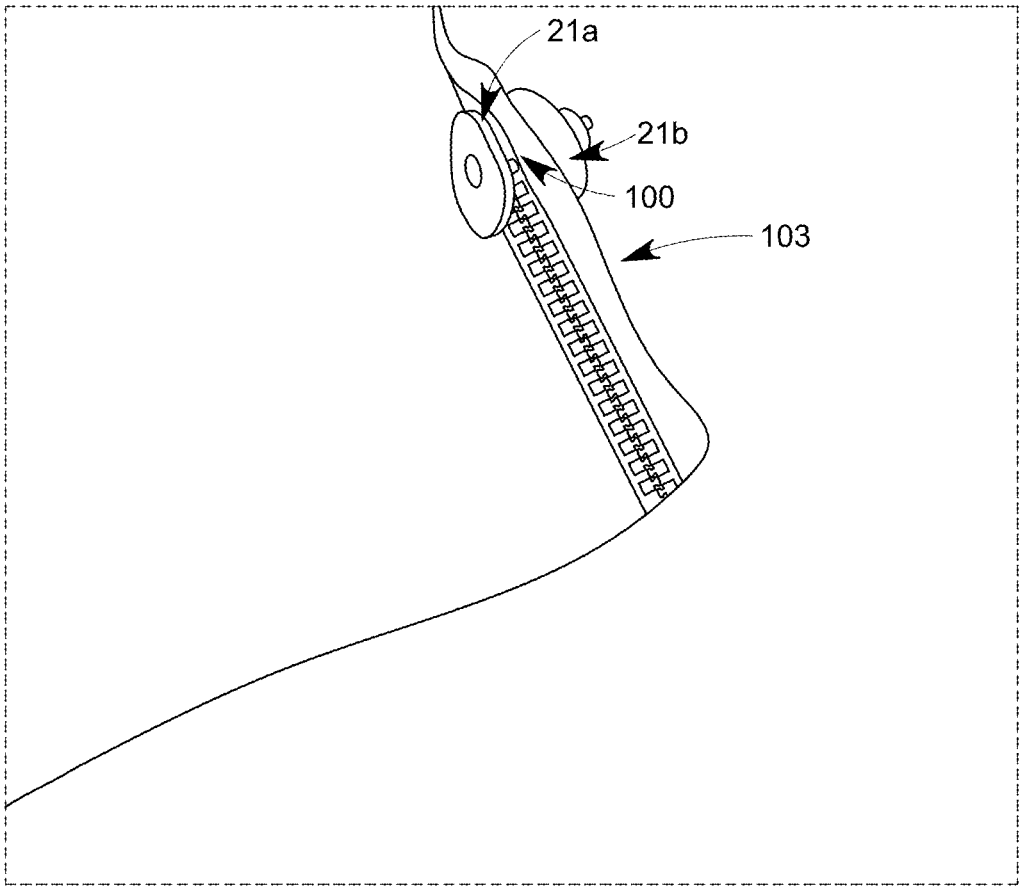
FIG. 9G shows another zoomed-in, perspective view of the embodiment of FIG. 9F.
Figure 9H:
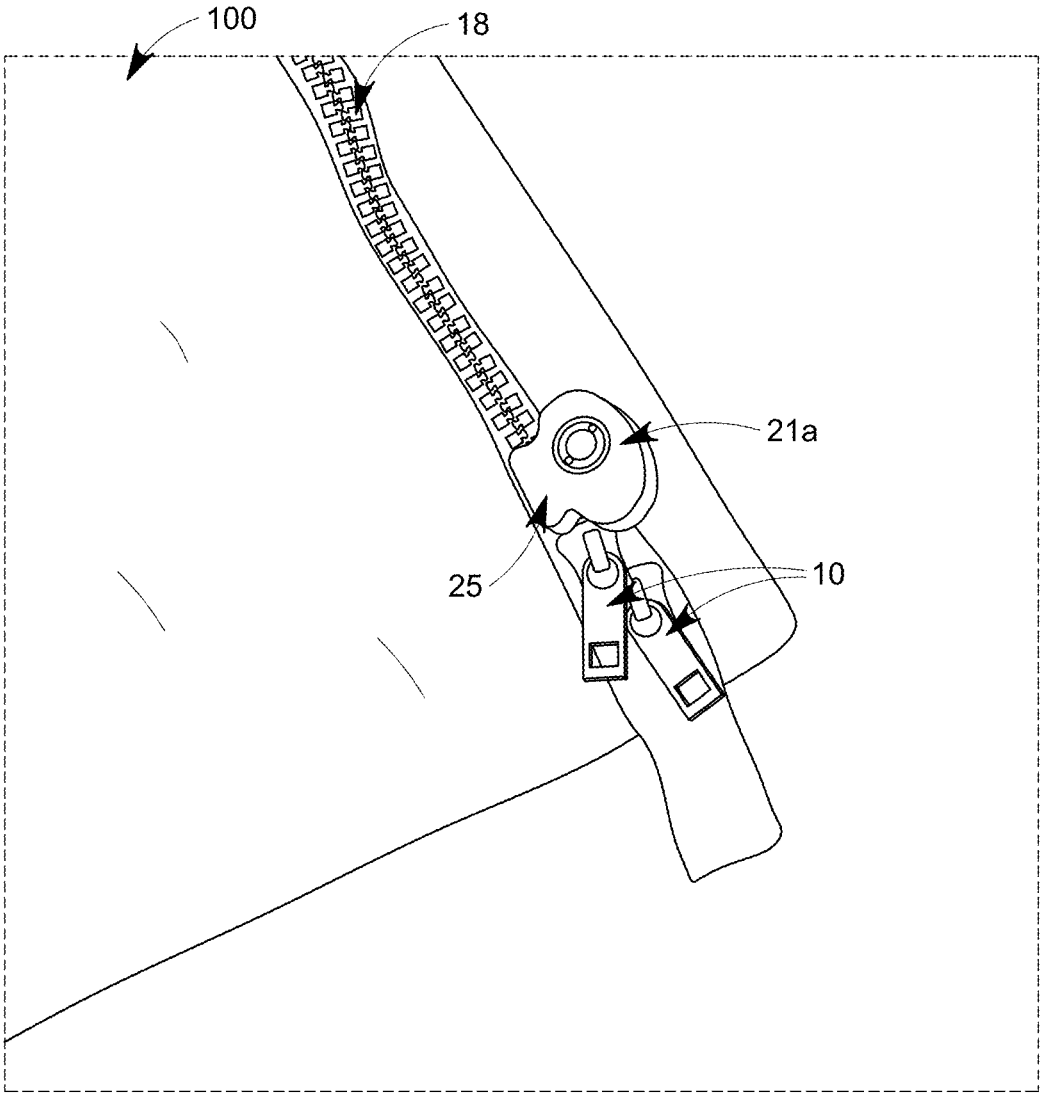
FIG. 9H shows a zoomed-in, top view of the embodiment of FIGS. 9F-9G.

As shown in FIG. 9B, the tether 108 (e.g., cable) may be secured on a bottom side 116 of the first compartment 100 by a lock mechanism 31. For example, the lock mechanism 31 may be a cable lock. Further for example, as shown in FIG. 9C, the lock mechanism may be a combination lock 114 such that the tether 108 is a shackle that may be threaded through the eyelets 34, 36. Still further for example, as shown in FIG. 9D, the lock mechanism may be a keyed lock 115 (compatible with keys 119), such that the tether 108 is a shackle that may be threaded through the eyelets 34, 36. Further for example, as shown in FIG. 9E, the lock mechanism may be a zip lock 117, such that the tether 108 is a zip tie that may be threaded through the eyelets 34, 36. The tether 108 may comprise or be formed of a cut-resistant material. The tether 108 may comprise or be formed of a braided or wound metal. The tether 108 may comprise or be formed of a ripstop material. The tether 108 may comprise or be formed of a tight pattern of weft and warp threads.

FIGS. 9F-9H show an embodiment of a lock mechanism that at least partially crosses a closure mechanism of a compartment to secure one or more valuables therein. As shown in FIGS. 9F-9G, the lock mechanism or clamp 51 includes a first clamp portion 21*a* coupled to a coupling element 23 (e.g., a tightening screw or the like). The coupling element 23, on a top side 101 of the first compartment 100, may extend through an eyelet 34 on a side of, or adjacent to, the closure mechanism 18. The first clamp portion 21*a* may be sized such that the first clamp portion 21*a* cannot pass through the eyelet 34. Instead, the first clamp portion 21*a* may be positioned to at least partially cross or traverse the closure mechanism 21*a*, as shown in FIG. 9H. For example, the first clamp portion 21*a* may include a protrusion 25 or extension that may overlay at least a portion of the closure mechanism to prevent movement of the zipper pull, more specifically the slide of the zipper, along the closure mechanism. Said another way, the first clamp portion 21*a*, or more particularly, the protrusion 25 or extension of the first clamp portion 21, may provide a backstop to the at least one zipper pull (or the slide of the zipper) to prevent the travel of the zipper pull (or the slide of the zipper) along the closure mechanism (e.g., prevent a first side and second side of the closure mechanism from being manipulated apart). As shown in FIG. 9G, a second clamp portion 21*b* may be matingly engaged with the coupling element 23 on a bottom side 103 of the first compartment 100. For example, the second clamp portion 21*b* may be threaded or press fit onto the coupling element 23. When the first clamp portion 21*a* is secured to the second clamp portion 21*b*, the eyelet 34 and a portion of the material of the first compartment 100 may be pressed, compressed, or otherwise compacted between the first clamp portion 21*a* and the second clamp portion 21*b*. As described above, the first clamp portion 21*a* may be positioned to at least partially cross, overlay, or traverse the closure mechanism 18, as shown in FIG. 9H. The clamp 51 may be further locked in position (at least partially crossing or overlaying the closure mechanism 18) by locking the clamp 51 with a key, combination, or otherwise. Because the clamp 51 at least partially crosses the closure mechanism 18, the zipper 10 may be prevented from navigating the length of the closure mechanism 18 and thus prevent access to one or more valuables stored in the first compartment 100.

Figure 10:
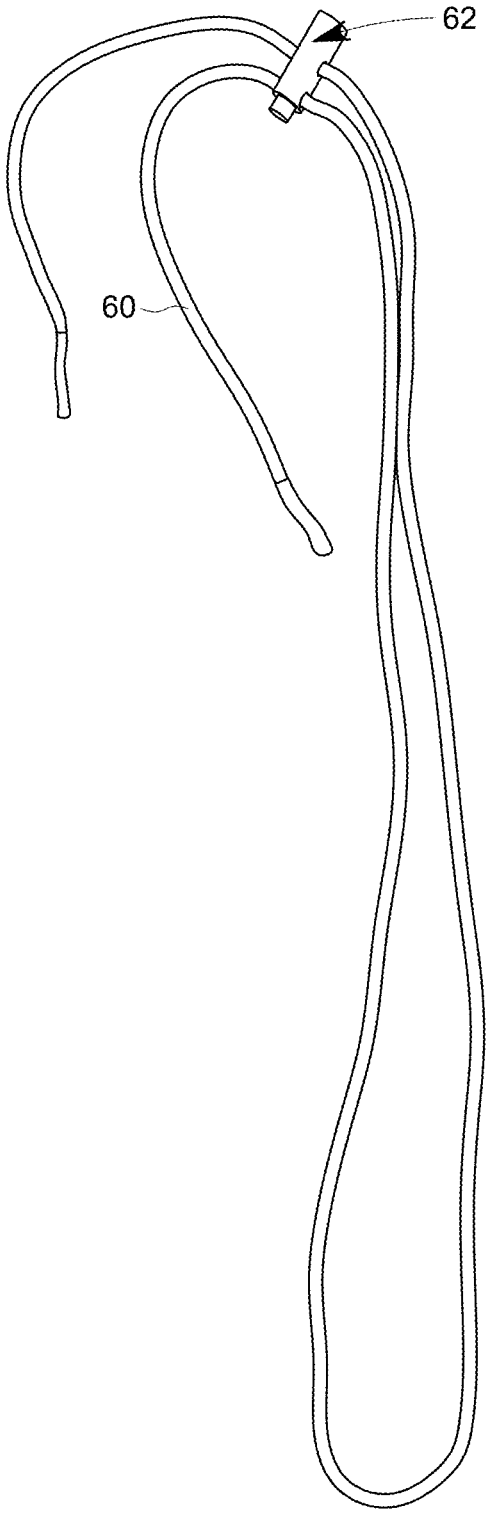
FIG. 10 shows an embodiment of a strap for securing a second compartment during transportation of the second compartment.
Figure 11:
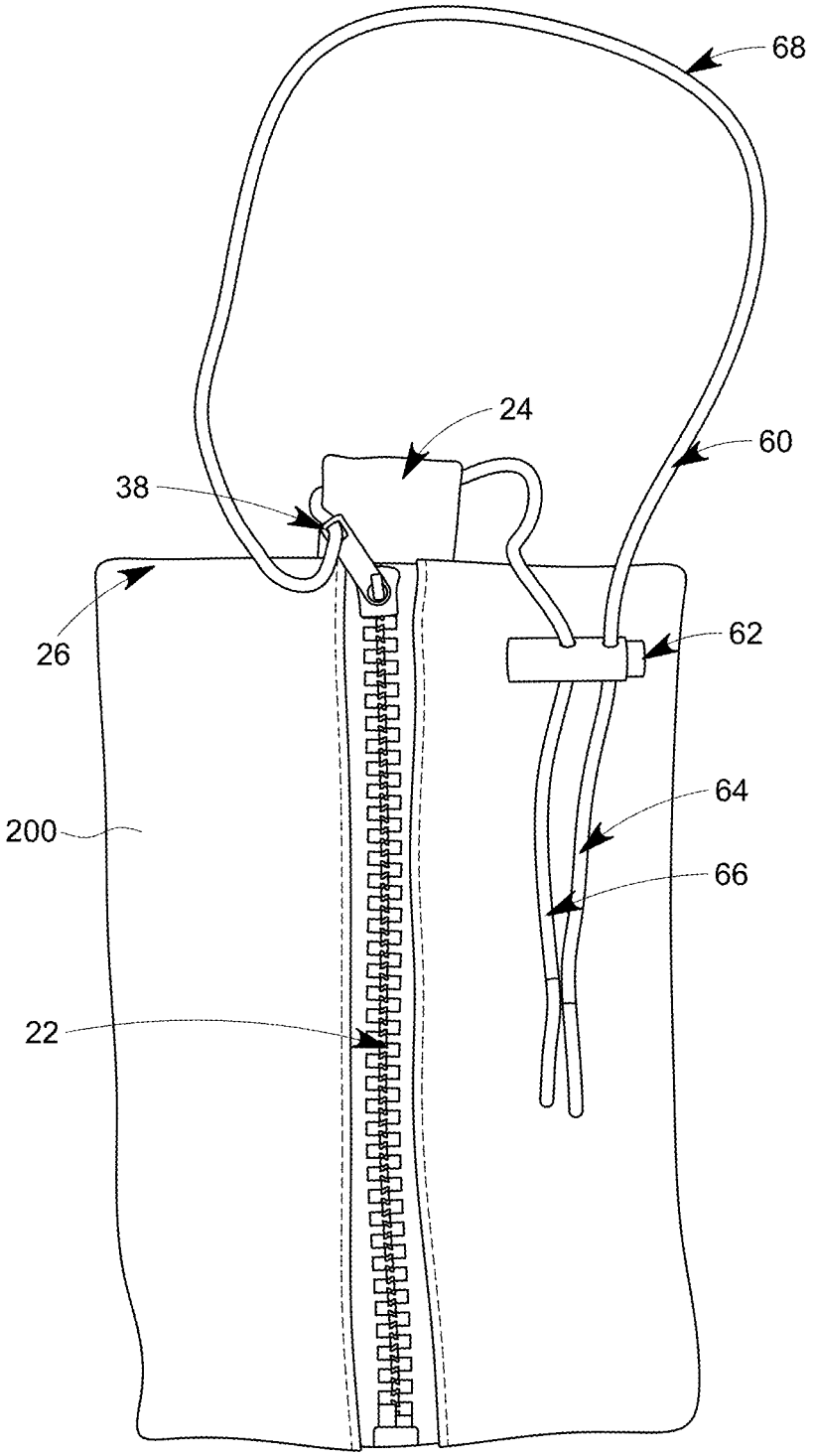
FIG. 11 shows the strap of FIG. 10 secured to a closure mechanism and loop of a second compartment.

In some embodiments, as shown in FIG. 10, the system 400 may optionally further include a strap 60 for securing the system 400, first compartment 100, second compartment 200, or otherwise to a user, a pet, a transportation mechanism (e.g., bike), or the like. For example, as shown in FIG. 11, the strap 60 may enable the second compartment 200 to be carried by or worn by a user. Cable 60 may be threaded through loop 24 and zipper pull 38 of closure mechanism 22 of the second compartment 200. The first end 64 and second end 66 of the cable 60 may be secured to one another by a lock mechanism 62 (e.g., cable lock or other lock mechanism) to create a strap 68 for a user to sling over their shoulder or to carry the bag. By threading the strap 60 through the loop 24 and zipper pull 38, the closure mechanism 22 may not be readily accessed by a thief, a pick pocketer, or the like when a user is wearing the second compartment 200.

Figure 13:
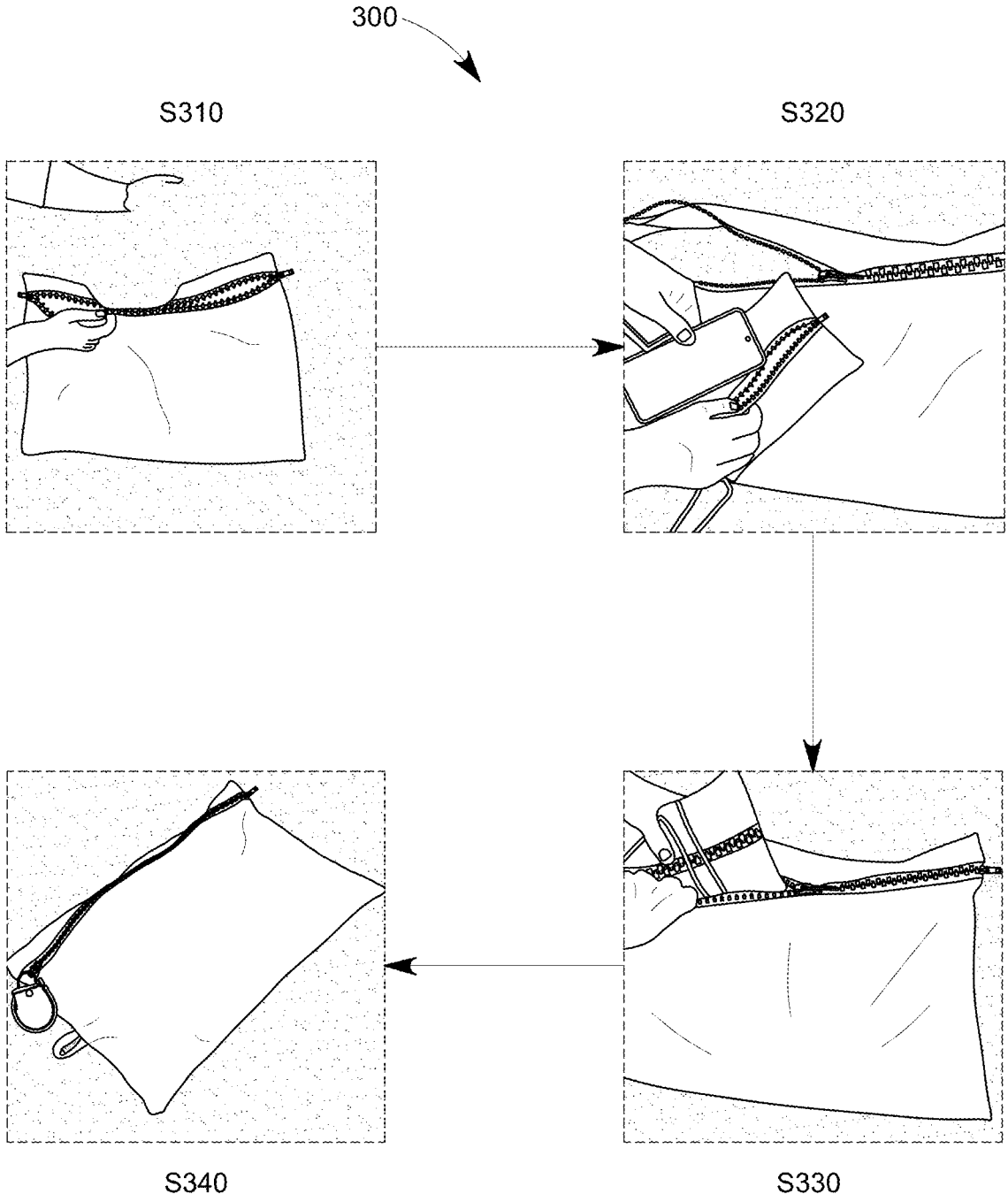
FIG. 13 shows an embodiment of a method for securing one or more valuables in a sand environment.

FIG. 13 shows an embodiment of a method 300 for securing one or more valuables in a sand environment. The method 300 may include filling a first compartment 100 with sand at block S310; securing one or more valuables 33 in a second compartment 200 at block S320; positioning the second compartment 200 in the first compartment 100 at block S330; and securing the first compartment 100 with a lock mechanism 31 (e.g., any of lock mechanisms of FIGS. 4, 5A, 7A, 8, 9A-9E) at block S340. Although blocks S310-S340 are shown in a particular sequence in FIG. 13, one of skill in the art will appreciate that the blocks may be performed in alternative sequences. For example, blocks S310 and S320 may have a reverse order. At the end of a use cycle, the lock mechanism 31 of the first compartment 100 may unlocked to allow the second compartment 200 to be removed and, optionally, the contents (e.g., one or more valuables 33) emptied. The first compartment 100 may be emptied of sand, returning the sand back to the environment. The empty first compartment 100 may be folded or compressed before storing the first compartment 100 in the second compartment 200 and closing the second compartment 200. In some embodiments, the lock mechanism 31 can be threaded through the closure mechanism of the second compartment 200.

As shown in FIG. 13, an embodiment of a method 300 for securing one or more valuables 33 in a sand environment includes block S310, which recites filling a first compartment 100 with sand. Filling the first compartment 100 with sand functions to provide weight in the first compartment 100 to reduce or prevent movement (e.g., theft) of the first compartment 100. As described elsewhere herein, a capacity of the first compartment 100 (e.g., the first compartment 100 may hold) may be about at least about 30 pounds; about 30 pounds (13.6 kg) to about 70 pounds (31.8 kg), about 40 pounds (18.1 kg) to about 60 pounds (27.2 kg), about 35 pounds (15.9 kg) to about 55 pounds (24.9 kg), or about 50 pounds (22.7 kg). For example, the first compartment 100 may be filled until a material forming the first compartment 100 is substantially taut.

As shown in FIG. 13, an embodiment of a method 300 for securing one or more valuables in a sand environment includes block S320, which recites securing one or more valuables 33 in a second compartment 200. One or more valuables 33 may be positioned in the second compartment 200 and the second compartment 200 closed or sealed by a closure mechanism 22. Positioning the one or more valuables 33 in the second compartment 200 may include positioning the one or more valuables 33 in an interior of the second compartment 200. Positioning the one or more valuables 33 in the second compartment 200 may include positioning the one or more valuables 33 in a volume defined by the second compartment 200. A volume of the second compartment 200 may be about 50 cubic inches (0.0008 cubic meters) to about 500 cubic inches (0.008 cubic meters); about 100 cubic inches (0.002 cubic meters) to about 400 cubic inches (0.007 cubic meters); about 100 cubic inches (0.002 cubic meters) to about 300 cubic inches (0.005 cubic meters); about 150 cubic inches (0.00025 cubic meters) to about 250 cubic inches (0.004 cubic meters); or about 210 cubic inches (0.003 cubic meters).

The second compartment 200 may comprise or be formed of a water-resistant or waterproof material, for example, to prevent or reduce the likelihood that the one or more valuables 33 are exposed to moisture from the sand in the first compartment 100. For example, the water-resistant or waterproof material may be one or more or a combination of: neoprene, elastane, econyl, nylon, polytetrafluoroethylene, natural rubber, synthetic rubber, ARIAPRENE®, Polartec®, or similar material. A closure mechanism 22 of the second compartment 200 may comprise hook and loop fasteners, a zipper, or the like. For example, the zipper may be formed of marine grade molded plastic. A gauge of the zipper slide of the closure mechanism 22 may be a 4-gauge or greater, for example a 5-gauge, a 7-gauge, an 8-gauge, or a 10-gauge. The second compartment 200 may be further locked with a lock mechanism, for example any of the lock mechanisms shown and/or described herein (e.g., any associated with FIGS. 4, 5A, 7A, 8, 9A-9E).

As shown in FIG. 13, an embodiment of a method 300 for securing one or more valuables 33 in a sand environment includes block S330, which recites positioning the second compartment 200 in the first compartment 100. The positioning of the second compartment 200 in the first compartment 100 may occur before or after the first compartment 100 is filled with sand. Positioning the second compartment 200 in the first compartment 100 may include positioning the second compartment 200 in an interior 102 of the first compartment 100. Positioning the second compartment 200 in the first compartment 100 may include positioning the second compartment 200 in a volume defined by the first compartment 100. For example, a volume of the first compartment 100 may be about 1,000 cubic inches (0.0164 cubic meters) to about 2,500 cubic inches (0.041 cubic meters); about 1,200 cubic inches (0.02 cubic meters) to about 2,000 cubic inches (0.033 cubic meters); about 1,500 cubic inches (0.025 cubic meters) to about 2,000 cubic inches (0.033 cubic meters); about 1,600 cubic inches (0.026 cubic meters) to about 1,800 cubic inches (0.029 cubic meters); or about 1,700 cubic inches (0.028 cubic meters).

As shown in FIG. 13, an embodiment of a method 300 for securing one or more valuables in a sand environment includes block S340, which recites securing the first compartment 100 with a lock mechanism 31. The lock mechanism 31 may be any of those shown and/or described herein or with respect to FIGS. 4, 5A, 7A, 8, 9A-9E. The first compartment 100 may include a rip-resistant material. For example, the first compartment 100 may include a polyester, cotton, linen, leather, elastane, or similar material. The material may be a high-density wave, for example a rip-stop weave. A material of the first compartment 100 may further be water-resistant or waterproof. For example, a material of the first compartment 100 may be treated with a water repellent.

The method 300 may optionally further include securing one or more external valuables 150 to a loop 12, 16 of the first compartment 100 (e.g., couple loop 12 or loop 16 to the external valuable). Due to the weight of the sand in the first compartment 100, the one or more external valuables 150 may be prevented (or reduce a likelihood) from floating away (e.g., paddle board, jet ski, pontoon, other watercraft, etc.). Due to the weight of the sand in the first compartment 100, the one or more external valuables 150 may be prevented (or reduce a likelihood) from wandering away (e.g., pet, child, etc.). Due to the weight of the sand in the first compartment 100, the one or more external valuables 150 may be prevented (or reduce a likelihood) from being stolen (e.g., garments, chair, beach bag, cooler, etc.).

References in the specification to "one embodiment," "an embodiment," "an illustrative embodiment," "some embodiments," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used in the description and claims, the singular form "a", "an" and "the" include both singular and plural references unless the context clearly dictates otherwise. For example, the term "valuable" may include, and is contemplated to include a plurality of valuables. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a method or system.

As used herein, the term "comprising" or "comprises" is intended to mean that the compartments, systems, and methods include the recited elements, and may additionally include any other elements. "Consisting essentially of" shall mean that the compartments, systems, and methods include the recited elements and exclude other elements of essential significance to the combination for the stated purpose. Thus, a compartment, system, or method consisting essentially of the elements as defined herein would not exclude other materials, features, or steps that do not materially affect the basic and novel characteristic(s) of the claimed disclosure. "Consisting of" shall mean that the compartments, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A system for securing valuables comprising:

a first compartment configured to store at least about 40 pounds of sand and comprising a closure mechanism, the first compartment having a top side located opposite a bottom side;

a second compartment configured to contain one or more valuables and is sized for positioning in the first compartment with the sand; and a lock mechanism comprising:

a coupling element having a first end located opposite a second end;

a first clamp portion connected to the first end of the coupling element and located on the top side of the first compartment;

a second clamp portion connected to the second end of the coupling element and located on the bottom side of the first compartment; and a protrusion structure extending from the first clamp portion, the protrusion structure at least partially disposed at a surface of the closure mechanism to block the closure mechanism from traversing at least a portion of a length of an opening of the first compartment, thereby reducing manipulation of the closure mechanism to reduce access to the second compartment within the first compartment.

2. The system of claim 1, further comprising a loop coupled to the first compartment, wherein the loop is couplable to an external valuable.

3. The system of claim 2, wherein the external valuable is one of: a watercraft, chair, pet, or child.

4. The system of claim 1, wherein the lock mechanism further comprises a shackle configured to be secured under a hook of the closure mechanism.

5. The system of claim 1, wherein the lock mechanism further comprises a tether configured to be threaded through eyelets defined by the first compartment, the eyelets being on opposite sides of the closure mechanism.

6. The system of claim 1, wherein the closure mechanism of the first compartment comprises at least one zipper pull or slider configured to be parked at an end of the first compartment.

7. The system of claim 1, wherein the closure mechanism comprises a marine grade zipper.

8. The system of claim 1, wherein the lock mechanism comprises a keyed lock or a combination lock.

9. The system of claim 1, wherein a portion of a material of the first compartment is configured to be compressed between the first clamp portion and the second clamp portion when the first clamp portion is secured to the second clamp portion.

10. A system for securing valuables comprising:

a first compartment with a top side located opposite a bottom side;

a fastener bordering at least a portion of an opening of the first compartment, the fastener configured to traverse at least a portion of a length of the opening of the first compartment; and a clamp comprising:

a coupling element having a first end located opposite a second end;

a first clamp portion connected to the first end of the coupling element, wherein the first clamp portion is located on the top side of the first compartment;

a second clamp portion connected to the second end of the coupling element, wherein the second clamp portion is located on the bottom side of the first compartment; and a protrusion structure extending from the first clamp portion and partially disposed at a surface of the fastener to block the fastener from traversing at least a portion of the length of the opening of the first compartment.

11. The system of claim 10, further comprising a second compartment configured to contain one or more valuables and be positioned within the first compartment, and wherein the first compartment is configured to store at least about 40 pounds of sand.

12. The system of claim 11, further comprising a loop coupled to the first compartment, wherein the loop is couplable to an external valuable.

13. The system of claim 12, wherein the external valuable is one of: a watercraft, chair, pet, or child.

14. The system of claim 10, wherein the fastener is a closure mechanism selected from the group consisting of: a zipper, hook and loop fastener, or marine-grade zipper.

15. The system of claim 10, wherein the clamp further comprises a shackle configured to be secured under a hook of the fastener.

16. The system of claim 10, wherein the clamp further comprises a tether configured to be threaded through eyelets defined by the enclosure, the eyelets being on opposite sides of the fastener.

17. The system of claim 10, wherein the coupling element is configured to be threaded through an eyelet adjacent to the fastener to secure the first clamp portion and the second clamp portion on opposite sides of the coupling element.

18. The system of claim 10, wherein the fastener is a marine-grade zipper.

19. The system of claim 10, wherein the protrusion structure further comprises a backstop to prevent movement of the fastener, reducing access to an interior of the compartment.

20. The system of claim 10, wherein a portion of a material of the first compartment is configured to be compressed between the first clamp portion and the second clamp portion when the first clamp portion is secured to the second clamp portion.

* * * * *